US012751570B2

(12) United States Patent
Lewis

(10) Patent No.: US 12,751,570 B2
(45) Date of Patent: Oct. 6, 2026

(54) MULTIFUNCTIONAL STACKABLE DISHWARE COLLECTION SYSTEM

(71) Applicant: James Bennett Lewis, San Francisco, CA (US)

(72) Inventor: James Bennett Lewis, San Francisco, CA (US)

( * ) Notice: Subject to any disclaimer, the term of this patent is extended or adjusted under 35 U.S.C. 154(b) by 418 days.

(21) Appl. No.: 18/135,737

(22) Filed: Apr. 18, 2023

(65) Prior Publication Data

US 2024/0049896 A1 Feb. 15, 2024

Related U.S. Application Data

(60) Provisional application No. 63/331,972, filed on Apr. 18, 2022.

(51) Int. Cl.
*A47G 19/23* (2006.01)
*A47G 19/02* (2006.01)

(52) U.S. Cl.
CPC ..... *A47G 19/23* (2013.01); *A47G 19/02* (2013.01)

(58) Field of Classification Search
CPC .... A47G 19/23; A47G 19/02; B65D 21/0234; B65D 21/33
See application file for complete search history.

(56) References Cited

U.S. PATENT DOCUMENTS 275,033 A * 4/1883 Gager ..... A47G 19/02 220/574
305,674 A * 9/1884 Dalzell
1,666,389 A 4/1928 Mander
1,866,035 A * 7/1932 Hart ..... A47G 19/02 220/574
1,978,175 A * 10/1934 Stalle ..... A47J 47/02 126/246
2,210,283 A 8/1940 Cowan
2,298,814 A 10/1942 Weis
2,564,834 A * 8/1951 Devine ..... A47G 19/23 206/508
2,664,193 A * 12/1953 Koch ..... A47G 19/23 156/224

(Continued)

FOREIGN PATENT DOCUMENTS

GB 2609252 A * 2/2023 ..... A47G 19/02

*Primary Examiner* — Anthony D Stashick
*Assistant Examiner* — Blaine G Neway
(74) *Attorney, Agent, or Firm* — THOMPSON HINE LLP

(57) ABSTRACT

A multifunctional dishware collection that can be used as tableware, cookware, and stackable containers. While each dish in the collection is designed to serve a stand-alone tableware function (such as a plate, a bowl, a saucer, et cetera), the dishware collection gains enhanced functionality by means of interfitting design features, molded into the interior and exterior surfaces of each dish, which increase the utility of the dishes in conjunction with one another: these interfitting design features allow different dishes to be paired together in a dovetailing, stable fashion to form various-sized lidded-containers and moreover enable these lidded-containers to be stacked on top of one another, likewise in a dovetailing, stable fashion. By repeating several design features at the same scale among different dishes, greater functional versatility is achieved in forming these lidded-containers and stacking arrangements.

16 Claims, 18 Drawing Sheets

(56) References Cited

U.S. PATENT DOCUMENTS

| | | | | | |
|---|---|---|---|---|---|
| 2,695,115 | A * | 11/1954 | Roop | B65D 21/0219 | 206/508 |
| 3,078,005 | A * | 2/1963 | Lewerth | A47G 19/02 | D7/584 |
| 3,145,870 | A | 8/1964 | Lockwood | | |
| 4,091,953 | A | 5/1978 | Daenen | | |
| 4,892,213 | A * | 1/1990 | Mason, Jr. | A47G 19/02 | 206/508 |
| 5,984,130 | A | 11/1999 | Hayes et al. | | |
| 6,796,430 | B2 * | 9/2004 | Mercier | B65D 21/0222 | 206/505 |
| 8,322,530 | B2 * | 12/2012 | Furlong | B65D 21/022 | 206/508 |
| 2004/0056036 | A1 * | 3/2004 | Tsai | A47G 19/23 | 220/556 |

* cited by examiner

MULTIFUNCTIONAL STACKABLE DISHWARE COLLECTION SYSTEM

FIELD OF THE INVENTION

A multifunctional dishware collection that serves as tableware, cookware, and stackable containers. Specifically, each dish within the collection serves a conventional function on its own, for example, a plate, a bowl, or a saucer, yet each of these dishes is able to pair with other dishes within the collection to serve as different sized lidded-containers or other functions. Additionally, these lidded-containers are able to be stacked upon each in different stacking configurations.

CROSS REFERENCE TO RELATED APPLICATIONS

This application claims the benefit of U.S. Provisional Patent Application No. 63/331,972 filed Apr. 18, 2022, entitled "Multifunctional Stackable Dishware Collection System", the disclosure of which is incorporated by reference herein in its entirety.

BACKGROUND OF THE INVENTION

This invention conceives a dishware collection designed with enhanced functionality, such that each dish within the collection serves a conventional function on its own, for example, a plate, a bowl, a saucer, et cetera; and all of these dishes are able to pair with other dishes within the collection versatilely to serve as different sized lidded-containers; and additionally, these lidded-containers are able to be stacked upon each in different stacking configurations.

The need to cover food that one has in a dish is commonplace. Whether it be to keep food warm before serving; or to keep food from splattering while heating it up in a microwave or oven; or perhaps, to keep food from drying out or otherwise losing freshness; there are many reasons one might want to cover one's food. Generally speaking, however, most dishes do not come with lids, which means that when a dish need to be covered it is done so in a makeshift manner, e.g., with tinfoil or plastic wrap, or possibly another dish not unintended for this purpose. Often when the food in a dish needs to be covered, it is simply transferred to a lidded-container. However common it might be to have both a set of dishes and a set of lidded-containers, in order to transfer food back and forth between them while preparing, serving, and storing the food, the need for a separate set of dishware and set of lidded-containers could be minimized for more space, efficiency, and less clean-up, with this invention.

The following is a tabulation of some prior art that presently appears relevant and will be addressed below:

| U.S. Patents | | | |
|---|---|---|---|
| Pat. No. | Kind Code | Issue Date | Patentee |
| 3,145,870 | A | 1964 Aug. 25 | W. H. Lockwood |
| 5,984,130 | A | 1999 Nov. 16 | Hayes et al. |
| 1,666,389 | A | 1926 Apr. 17 | James L. Mander |
| 2,210,283 | A | 1940 Aug. 6 | R. G. Cowan |
| 2,564,834 | A | 1951 Aug. 21 | J. H. Devine et al. |
| 2,298,814 | A | 1942 Oct. 13 | Albert M. Weis |
| 4,091,953 | A | 1978 May 30 | Robert H. C. M. Daenen |

Several relevant prior art references address efforts to create stackable, space-saving containers, describing receptacles with covers that can be stacked on top and sometimes alongside of one another, for shipping or storage, for example, U.S. Pat. No. 3,145,870 (1964) to W. H. Lockwood and U.S. Pat. No. 5,984,130 (1999) to Haye et al. Unfortunately, the base of the receptacle is of little to no value without the cover and vice versa.

The few patents that do consider modes of stacking pieces of dishware, where each piece serves a function on its own and not only as an auxiliary piece to another, generally lack versatility in how they are used with each other. The majority involve stackable cup and saucer arrangements, for instance, U.S. Pat. No. 1,666,389 (1926) to James L. Mander, U.S. Pat. No. 2,210,283 (1940) to R. G. Cowan, and U.S. Pat. No. 2,564,834 (1951) to J. H. Devine et al. It would be a stretch to claim that these were intended to form lidded-containers, since the saucer is generally underneath the cup, but stacking these cup-and-saucer pairings on top of one another, one can see how the saucer might also be used to cover the cup. However, if using the saucer in this way as a cover were intended, there is an obvious issue left unaddressed by this design: if food or liquid are in the covered receptacle, when you take the cover off, the underside of the cover is prone to having food or moisture left on it. Taking the saucer off the cup which it has been covering and resting it on the adjacent counter, this food or moisture would be left on that surface; if, to avoid this happening, one were to flip the saucer over, it would be difficult to lift the inverted dish back up again since it is not designed such that one can easily gain leverage of it when resting in this inverted position.

Similarly, with the few patents that involve stackable dishware containers, the collection is designed with limited enhanced functionality. For instance, U.S. Pat. No. 2,298,814 (1942) to Albert M. Weis and U.S. Pat. No. 4,091,953 (1978) to Robert H. C. M. Daenen describe lidded-containers being stackable in one possible configuration without concern for how the pieces might be used on their own or more versatilely with one another, that is to say, in different paired configurations. If someone were to try use the pieces of one of these lidded-container on their own as separate dishes, the lack of functional versatility would become obvious, particularly in regard to the pieces serving as lids, which like the saucer, as described above, has not been designed to address issues related to moisture or food collecting underneath a cover or lid when in use.

SUMMARY OF THE INVENTION

A multifunctional dishware collection that serves as tableware, cookware, and stackable containers. While each dish in the collection serves a traditional tableware function on its own (i.e., a plate, a bowl, a saucer, etc.), the different dishes can also be paired together in various ways to create multiple-sized containers and stacking arrangements.

In the preferred embodiment, there are several utility-enhancing features that are consistently employed to maximize the utility of this multifunctional, stackable dishware collection and endow it with advantages.

(A) Every dish has a stand-alone function and is interchangeable with like dishes, which means that no dish is simply auxiliary to another piece. (For instance, the dish referred to as the CEREAL BOWL can be used alone as a bowl or inverted to be used as a lid on top other dishes, such as the SALAD PLATE and the PASTA BOWL. So, the CEREAL BOWL is never just a lid for another piece (i.e., auxiliary to another piece), it has its own stand-alone function, and if one had 6 of these CEREAL BOWLS, each could be used interchangeably as a lid for any SALAD PLATE or PASTA BOWL, again interchangeably).

(B) every dish is designed to stack as a set on its own, in a nesting fashion, one on top of another (e.g., if one were to lift a stack of DINNER PLATES set on top of each other, they would be nested together in such a way that they would not slip or topple off one another).

(C) In every lidded-container configuration, the interior of each dishes faces the interior of the other, thus when the container is 'unlidded" the lid can be flipped back onto its base, no condensation or possible food residue is left on the resting surface/table/counter. (These containers are intended for a wide variety of purposes in which condensation often forms inside the lid, such as when baking, heating things up in the microwave, keeping things warm before serving, or storing foods in the refrigerator, to name a few).

(D) In the preferred embodiment, any dish serving as a lid, must have a flared, pedestal footing or some sort of protruding exterior ledge adjacent to the footing of the dish, which, when the dish is inverted and being used as a lid, allows the user to grab hold of the dish more easily and gain leverage more securely when lifting or setting it down on another piece, as one would do when using it as part of a lidded-container. (So, for the 8 dishes in the dishware collection described as the preferred embodiment for the purposes of this patent application (DEEP DISH SERVER, DINNER PLATE, SALAD PLATE, CUP WITH HANDLE, CEREAL BOWL, PASTA BOWL, SIDE DISH and SAUCER), only 4 of them (CEREAL BOWL, PASTA BOWL, SIDE DISH and SAUCER) are designed specifically to be inverted and used as lids, and each of these has a flared, pedestal footing or a protruding exterior ledge near the footing (as in the case of the SIDE DISH) that allows one to gain leverage when inverted.

(E) Finally, whether pairing dishes to form lidded-containers or stacking lidded-containers on top of one another in different stacking configurations, the pieces are designed to rest upon each other stably in a dovetailing fashion, held in place by complementary design features (i.e., not just a balancing act), as will be shown with in our discussion of the preferred embodiment of the dishware collection.

In the preferred embodiment, each of these functional design elements (A-E) listed above is respected to maximize the utility of this multifunctional, stackable dishware system as described below with the preferred embodiment of the dishware collection.

A brief description of the figures and a more detailed description of the invention follows, that will explain how design features are embodied in the 8-dish preferred embodiment of the collection such that different dishes fit together to enhance the utility of a conventional dishware set, allowing one to use the dishes to form multiple-sized containers and stacking arrangements.

DETAILED DESCRIPTION OF THE INVENTION

Figure 1A:
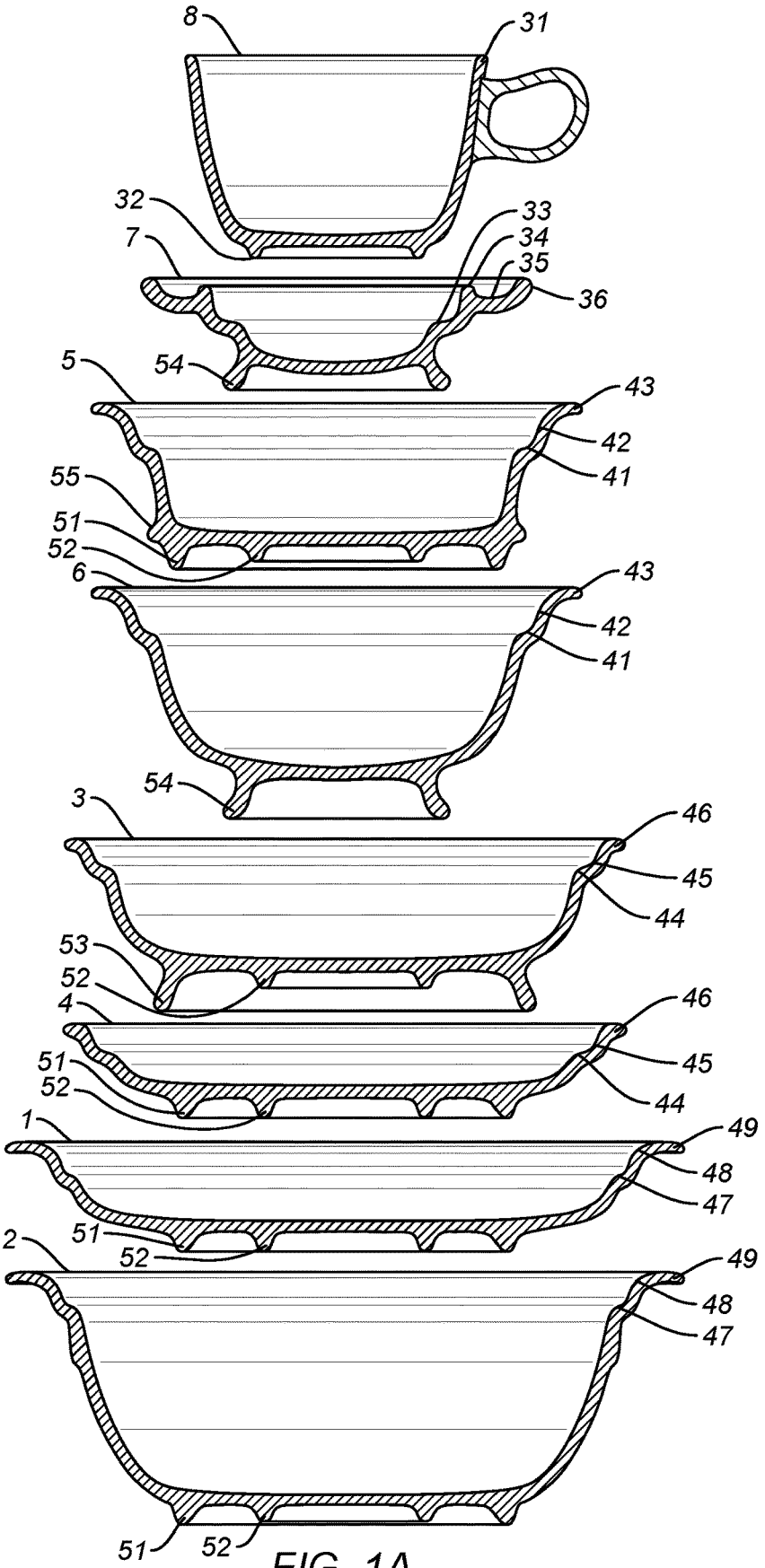
FIG. 1A shows the eight dishes together which will be used to illustrate the preferred embodiment of this multifunctional dishware collection: DINNER PLATE (1), DEEP-DISH SERVER (2), PASTA BOWL (3), SALAD PLATE (4), SIDE DISH (5), CEREAL BOWL (6), SAUCER (7), CUP WITH HANDLE. (8)

A multifunctional dishware collection that serves as tableware, cookware, and stackable containers. While each dish in the collection serves a traditional tableware function on its own (i.e., a plate, a bowl, a saucer, etc.), the different dishes can also be paired together in various ways to create multiple-sized containers and stacking arrangements.

In the preferred embodiment, there are several utility-enhancing features that are consistently employed to maximize the utility of this multifunctional, stackable dishware collection, allowing it both to meet and to exceed the benefits of a convention dishware collection.

(A) Every dish has a stand-alone function and is interchangeable with like dishes, which means that no dish is simply auxiliary to another piece. (For instance, the dish referred to as the CEREAL BOWL can be used alone as a bowl or inverted to be used as a lid on top other dishes, such as the SALAD PLATE and the PASTA BOWL. So, the CEREAL BOWL is never just a lid for another piece (i.e., auxiliary to another piece), it has its own stand-alone function, and if one had 6 of these CEREAL BOWLS, each could be used interchangeably as a lid for any SALAD PLATE or PASTA BOWL, again interchangeably).

(B) Every dish is designed to stack as a set on its own, in a nesting fashion, one on top of another (e.g., if one were to lift a stack of DINNER PLATES set on top of each other, they would be nested together in such a way that they would not slip or topple off one another).

(C) In every lidded-container configuration, the interior of each dishes faces the interior of the other, thus when the container is 'unlidded" the lid can be flipped back onto its base, no condensation or possible food residue is left on the resting surface/table/counter. (These containers are intended for a wide variety of purposes in which condensation often forms inside the lid, such as when baking, heating things up in the microwave, keeping things warm before serving, or storing foods in the refrigerator, to name a few).

(D) In the preferred embodiment, any dish serving as a lid, must have a flared, pedestal footing or some sort of protruding exterior ledge adjacent to the footing of the dish, which, when the dish is inverted and being used as a lid, allows the user to grab hold of the dish more easily and gain leverage more securely when lifting or setting it down on another piece, as one would do when using it as part of a lidded-container. (So, for the 8 dishes in the dishware collection described as the preferred embodiment for the purposes of this patent application (DEEP DISH SERVER, DINNER PLATE, SALAD PLATE, CUP WITH HANDLE, CEREAL BOWL, PASTA BOWL, SIDE DISH and SAUCER), only 4 of them (CEREAL BOWL, PASTA BOWL, SIDE DISH and SAUCER) are designed specifically to be inverted and used as lids, and each of these has a flared, pedestal footing or a protruding exterior ledge near the footing (as in the case of the SIDE DISH) that allows one to gain leverage when inverted.

(E) Finally, whether pairing dishes to form lidded-containers or stacking lidded-containers on top of one another in different stacking configurations, the pieces are designed to rest upon each other stably in a dovetailing fashion, held in place by complementary design features (i.e., not just a balancing act), as will be shown with in our discussion of the preferred embodiment of the dishware collection.

In the preferred embodiment, each of these functional elements (A-E) listed above is respected to maximize the utility of this multifunctional, stackable dishware system as described below with the preferred embodiment of the dishware collection.

A brief description of the figures and a more detailed description of the invention follows, that will explain how features are embodied in the 8-dish preferred embodiment of the collection such that different dishes fit together to enhance the utility of a conventional dishware set, allowing one to use the dishes to form multiple-sized containers and stacking arrangements.

First, some naming conventions will be helpful for this detailed description: Each dish has an 'exterior' surface, which corresponds with the underside of the dish when it is being used alone, resting on a flat surface; and each dish has an 'interior' surface, which corresponds with the top, open-faced side of the dish when it is being used alone, resting on a flat surface. Accordingly, features described as 'interior', such as an 'interior raised ledge' are features that are employed on the interior surface; likewise, denoting an 'exterior' feature is meant to locate the feature on the exterior surface of the piece. It is particularly important to make these distinctions because when the dishes are used to form a lidded-container, one of them will be turned upside down, making it easy to start confusing top and bottom as one describes the features that allow for the dishes to fit together to form lidded containers and the stacking arrangements of two or more lidded containers. (For instance, a CEREAL BOWL can be flipped over to serve as a lid, which means the 'top' of this lid is also the 'bottom' of the dish when used on its own as a CEREAL BOWL).

A lidded-container is comprised of two dishes, one serving as the container's 'base', and another placed on top of it, serving as the container's 'lid'. All lidded-container are formed by fitting together two dishes such that the interior surface of one interfaces with the interior surface of the other. Thus, the way that lidded-containers are formed depends an interior feature of one dish being designed to fit together with a corresponding interior feature on another piece.

All lidded-containers fit together in a similar fashion. There is a raised ledge on the interior surface of the dish serving as the base of the lidded-container. This 'interior raised ledge' is formed when interior curvature of the dish breaks outward, leveling off horizontally briefly to form a ledge, before continuing its ascent. This raised interior ledge demarcates the part of the dish that will be covered when the lid is set down. The part above this raised interior ledge will be called the 'lip' of the piece, and the uppermost edge (where the interior meets the exterior of the piece) will be referred to as the 'rim'.

In each lidded-container, the rim of the dish serving as a lid rests upon the interior raised ledge of the dish serving as a base and is held in place by the lip of the base-dish which extend upward and outward beyond the interior raised ledge, forming a kind of backstop against which the rim of the lid-dish settles down onto the ledge. The shape, size, and width of this raised interior ledge mirrors closely the shape, size, and width of the rim. For example, in FIG. 4E, which shows the PASTA BOWL serving as the base and the CEREAL BOWL serving as the lid of this two-piece lidded-container, one can see how the rim of the CEREAL BOWL rests upon the interior raised ledge of the PASTA BOWL and also how the lip of the PASTA BOWL, rising up at the outer edge of said interior raised ledge, functions as a sort of backstop that hold said rim of the CEREAL BOWL in place on said interior raised ledge.

Now taking into consideration how two or more lidded-containers are stacked on top of one another, this stacking arrangement depends on the exterior features of one dish being designed to fit together with corresponding exterior features on another piece. Thus, to describe how different lidded-containers stack on top of one another, one must describe how the exterior features of the dish serving as the base on the upper of two stacked lidded-containers rest stably in place on the exterior features of the dish serving as the lid on the lower of two lidded-containers, the footing on the bottom of one piece fitting together in dovetailing fashion with the footing of another piece.

In the preferred embodiment being described here, there are basically 5 different ring footings employed: The alpha-ring footing, the beta-ring footing, the gamma-ring footing, the large-flared pedestal footing, and the medium-flared pedestal footing. The same alpha-ring footing is on the following 4 pieces: the DINNER PLATE (1), DEEP-DISH SERVER (2), SALAD PLATE (4), and SIDE DISH. (5) The same beta-ring footing is on the following 5 pieces: DINNER PLATE (1), DEEP-DISH SERVER (2), PASTA BOWL (3), SALAD PLATE (4), and SIDE DISH. (5) The gamma-ring footing is only on The CUP WITH HANDLE (8); it is very similar to the beta-ring footing, the same diameter but slightly less pronounced. In this preferred embodiment, the large-flared pedestal footing is only on the PASTA BOWL (3). And finally, the same medium-flared pedestal footing is both on the CEREAL BOWL (6) and on the SAUCER. (7)

For the sake of clarity in describing how the pieces fit together, sometime we will distinguish the distal portion of the footing versus the proximal portion of the footing. The side of the footing which is outward-facing will be referred to as the distal portion (or side) of the ringed footing, and an opposing side of the ring that faces the center point of the dish, will be referred to as the proximal portion (or side) of the ring footing.

Now looking again at FIG. 1A, all eight dishes are shown together in the preferred embodiment of this multifunctional dishware collection. Each of these eight dishes has been named and given a reference number. These names and reference numbers will be used throughout the drawings and the description to help the reader keep track of how the dishes are paired together and stacked: DINNER PLATE (1), DEEP-DISH SERVER (2), PASTA BOWL (3), SALAD PLATE (4), SIDE DISH (5), CEREAL BOWL (6), SAUCER (7), and CUP WITH HANDLE. (8)

These names are not meant to specify in a limiting fashion how these dishes will be used. Of course, the dish referred to as 'cereal bowl' for the purposes of this description could be used for eating soup, or holding berries, or beating an egg, et cetera. These names simply suggest different sorts of conventional usage that one might associate with the shape of the dish. Likewise, the scale of these dishes is not being specified here—these dishes could be embodied with a good deal of variance so long as the features are shared and aligned in a manner illustrated by this preferred embodiment which will be described herein.

The different dishes in FIG. 1 are shown 'hovering' over one another, all centered along one axis, so that one can see their relative scale to one another and to show how many of the dishes share similar features. As will be shown, these shared features allow many of the dishes to fit together in similar ways, often interchangeably.

Here is the key to the numerical designations used in labeling the figures:

| FIG. Labeling Key | |
|---|---|
| 1 | Dinner Plate |
| 2 | Deep Dish Server |
| 3 | Pasta Bowl |
| 4 | Salad Plate |
| 5 | Side Dish |
| 6 | Cereal Bowl |
| 7 | Cup with Handle |
| 8 | Saucer |
| 31 | Rim of Cup with Handle |
| 32 | Gamma-Ring of Cup with Handle |
| 33 | Raised Interior Ledge of Saucer |
| 34 | Delta-Ring on Saucer |
| 35 | Scalloped Lip of Saucer |
| 36 | Rim of Saucer |
| 41 | Interior Raised Ledge of Side Dish & Cereal Bowl |
| 42 | Lip of Side Dish & Cereal Bowl |
| 43 | Rim of Side Dish & Cereal Bowl |
| 44 | Interior Raised Ledge of Pasta Bowl & Salad Plate |
| 45 | Lip of Pasta Bowl & Salad Plate |
| 46 | Rim of Pasta Bowl & Salad Plate |
| 47 | Interior Raised Ledge of Dinner Plate & Deep-Dish Server |
| 48 | Lip of Dinner Plate & Deep-Dish Server |
| 49 | Rim of Dinner Plate & Deep-Dish Server |
| 51 | Alpha-Ring Footing (wider outer ring) |
| 52 | Beta-Ring Footing (narrower inner ring) |
| 53 | Large-Flared Pedestal Footing (of Pasta Bowl) |
| 54 | Wide-Flared Pedestal Footing (of Cereal Bowl & Saucer) |
| 55 | Protruding Exterior Ledge (at the base of the Side Dish) |

Each of these numerical designation is used in FIG. 1A, many of them repeatedly. If the numerical designation is repeated on different dishes, it is meant to indicate the design feature is proportionally equivalent on these different dishes, and these dishes will share some functional congruency or interchangeability. For instance, the 'Interior Raised Ledge of the PASTA BOWL' and the 'Interior Raised Ledge of the SALAD PLATE' are proportionally equivalent, so both share same numerical designation of '44'. Likewise, the 'Rim of the SIDE DISH' and the 'Rim of the CEREAL BOWL' are proportionally equivalent, so both share same numerical designation of '43'. These proportionally equivalent, shared features allow for some functional interchangeability. Both the Interior Raised Ledge of the PASTA BOWL and the Interior Raised Ledge of the PASTA BOWL will accommodate either the Rim of the SIDE DISH and the Rim of the CEREAL BOWL interchangeably to form 4 different-sized lidded-containers. These proportionally equivalent shared features are meant to increase the versatility of the dishware system, allowing more interchangeable pairing and stacking options.

Although there is only one piece, the PASTA BOWL, with the large-flared pedestal footing, one could introduce others dishes with this same design feature. Once again, it should be noted that there are other embodiments of these dishes that could be created with a similar interfitting geometry. Indeed, even with this preferred embodiment, one could add more pieces that would expand the benefits of the dishware system's enhanced utility so long as the new pieces tied into the rest of the collection with some shared design features. For instance, one could expand the collection by introducing a large platter with a greater diameter than the DINNER PLATE; this platter would also have a raised interior ledge like the other dishes, but with a greater diameter; this platter could have the same alpha- and beta-ring footing as the DINNER PLATE; to cover this new dinner platter, one might create a much wider deep dish server with a rim that aligns with the raised interior ledge of the platter; and finally, this wider deep dish server could the PASTA BOWL's large-flared pedestal footing and recessed beta-ring footing. This would allow these two additional pieces to tie into and expand the enhanced utility of the rest of the dishware collection.

Figure 2:
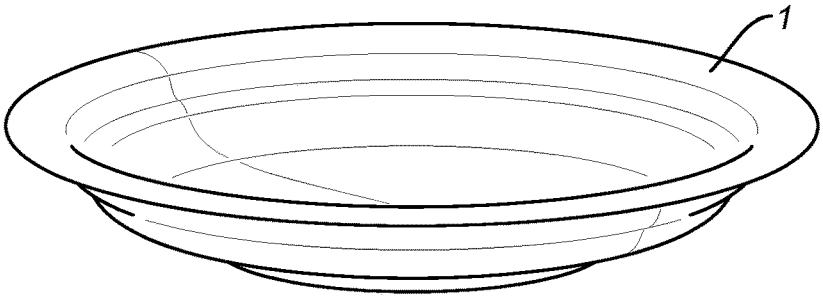
FIG. 2 shows the DINNER PLATE (1) alone.
Figure 2A:
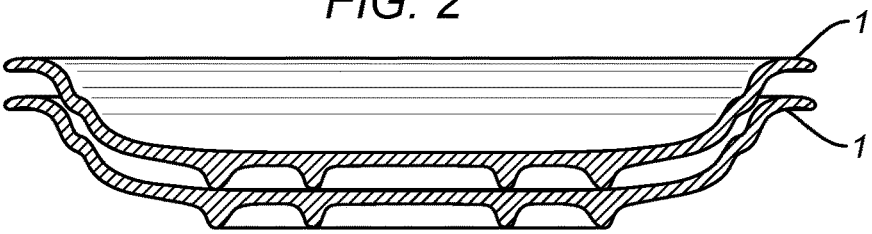
FIG. 2A shows a cross section of the DINNER PLATE (1) stacked on top of another DINNER PLATE. (1)
Figure 2B:
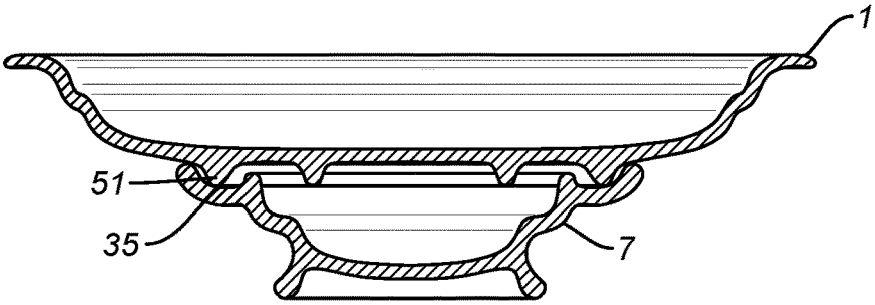
FIG. 2B shows the cross section of DINNER PLATE (1) stacked on top of the SAUCER (7) being used as a trivet or pedestal.
Figure 2C:
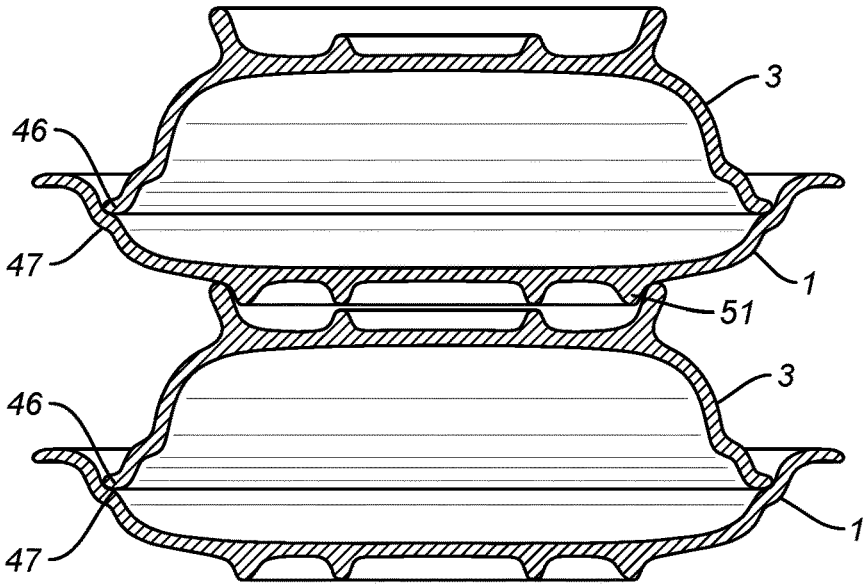
FIG. 2C shows a cross section of the DINNER PLATE (1) being covered by the PASTA BOWL (3), flipped over to serve as a lid, stacked on top of another DINNER PLATE (1) and PASTA BOWL (3) in the same configuration.

Now looking at FIG. 2C, one can see an example of how the footings of the dish matter when stacking them on top of other lidded-container configurations in order that the footings correctly interact (dovetail). For instance, The PASTA BOWL (3), which serves as a lid when inverted and set down on either the DINNER PLATE (1) or the DEEP-DISH SERVER (2), has the 'Large-Flared Pedestal footing' (53) that lift the dish and is just bit wider than the alpha-ring described above; (the PASTA DISH also has the beta-ring footing (41) which allows for other pieces to stack upon it, but that will be explained below).

In the preferred embodiment where we consider round, circular dishes, taking FIG. 2C as an example again, when stacking another dish on this inverted PASTA BOWL (3) serving as a lid, any one of the dishes with the alpha-ring footing (51) will settle into and within the large-flared pedestal footing of the PASTA BOWL, such that the proximal portion of the large-flared-pedestal footing of the PASTA BOWL (3) will have a circumference just slightly larger than the distal portion of the alpha-ring footing. In FIG. 2C, this is the distal portion of the DINNER PLATE's alpha-ring footing, but it would be the same for any of the other piece that have this same alpha-ring footing interchangeably (in addition to the DINNER PLATE, the DEEP DISH SERVER, SALAD PLATE, and SIDE DISH as well), because the circumference of the Large-Flared Pedestal Footing of the PASTA BOWL (53) is wider in the proximal portion (the inner circumference of the large-flared pedestal footing) than the circumference of the outward-facing distal portion of alpha-ring footing, thus allowing the distal portion of the Alpha-Ring Footing (51) to dovetail with the inward-facing proximal portion of the Large-Flared Pedestal Footing of the PASTA BOWL (53) and be held in place as shown int FIG. 2C.

Here is a list (repeating the example from the previous paragraphs for the sake of completeness) of notable examples of proportionally equivalent, shared features of the preferred embodiment which allow for congruent functionality or interchangeability: (a) the two-ringed alpha ring footing (51) and beta ring footing (52) of the SIDE DISH (5), SALAD PLATE (4), DINNER PLATE (1), and DEEP-DISH SERVER (2); (b) the medium-flared-ring pedestal footing of the CEREAL BOWL and the SAUCER (54) of these two dishes fits the smaller beta-ring footing (52), whereas the large-Flared Pedestal Footing of the PASTA BOWL (53) fits the Alpha Ring Footing (51); (c) the interior raised ledge of the SIDE DISH (5) and CEREAL BOWL (41) corresponds with the rim of the SAUCER (36) when it is used as a lid; (d) the interior raised ledge of the PASTA BOWL and SALAD PLATE (44) correspond with the rim of the SIDE DISH and CEREAL BOWL (43) when they are used as lids; and, (e) the interior raised ledge of the DINNER PLATE and DEEP-DISH SERVER (47) correspond with the rim (46) of the PASTA BOWL (3) when it is used as a lid.

Figure 1B:
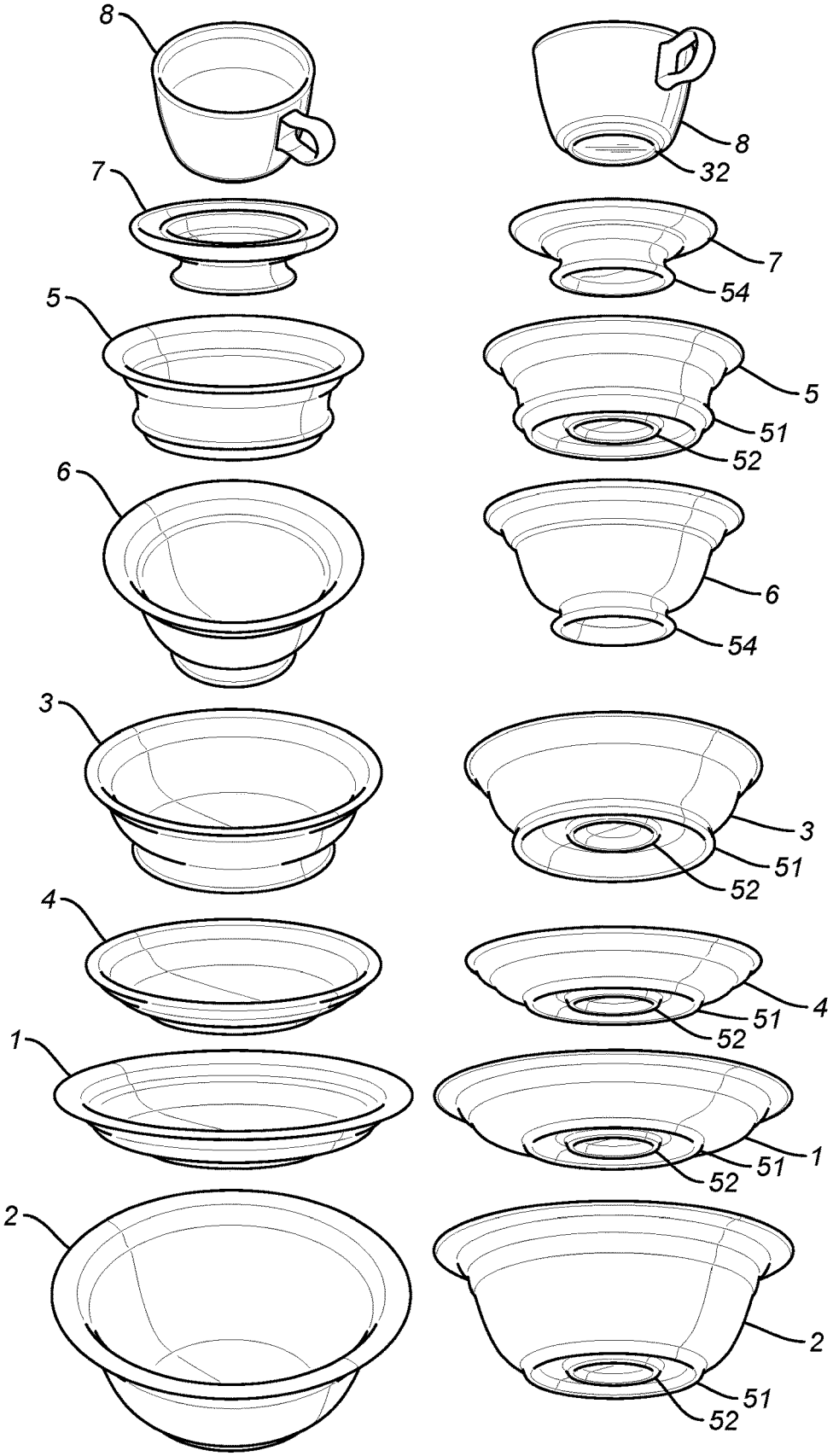
FIG. 1B shows two 3D renderings of each piece of the preferred embodiment of this multifunctional dishware collection, one from a bird's eye perspective looking downward at an oblique angle to illustrate the interior surface of each piece (appearing in the left column) and the other from a perspective looking up at an oblique angle to illustrate the exterior surface of each piece (appearing in the right column): DINNER PLATE (1), DEEP-DISH SERVER (2), PASTA BOWL (3), SALAD PLATE (4), SIDE DISH (5), CEREAL BOWL (6), SAUCER (7), CUP WITH HANDLE. (8)

FIG. 1B shows two 3D renderings of each piece of the preferred embodiment of this multifunctional dishware collection, one from a bird's eye perspective looking downward at an oblique angle to illustrate the interior surface of each piece (appearing in the left column) and the other from a perspective looking up at an oblique angle to illustrate the exterior surface of each piece (appearing in the right column): DINNER PLATE (1), DEEP-DISH SERVER (2), PASTA BOWL (3), SALAD PLATE (4), SIDE DISH (5), CEREAL BOWL (6), SAUCER (7), COFFEE CUP. (8)

FIG. 2 shows a DINNER PLATE (1) alone. FIGS. 2A through E show various configurations featuring the functionality of the DINNER PLATE (1) in different stacking configurations.

FIG. 2A shows a cross section of the DINNER PLATE (1) stacked on top of another DINNER PLATE (1). The figure demonstrates how the interior and exterior of the DINNER PLATE (1) are designed to nest with one another.

FIG. 2B shows the cross section of the DINNER PLATE (1) stacked on top of the SAUCER (7) being used as a trivet or pedestal. The Alpha-Ring Footing (51) of the DINNER PLATE settles stably into place along the Scalloped Lip of the SAUCER. (35)

FIG. 2C shows a cross section of the DINNER PLATE (1) being covered by the PASTA BOWL (3), flipped over to serve as a lid, stacked on top of another DINNER PLATE (1) and PASTA BOWL (3) in the same configuration. The figure demonstrates how the Interior Raised Ledge of the DINNER PLATE (47) accommodates the Rim of the PASTA BOWL (46) (which has been inverted to serve as a lid), such that the two dishes fit together to form a lidded-container; and it also shows how The Alpha-Ring Footing (51) of the DINNER PLATE (1) fits into the Large-Flared Pedestal Footing of the PASTA BOWL (53) when inverted as a lid, allowing these two lidded-containers to be stably stacked on top of each other.

Figure 2D:
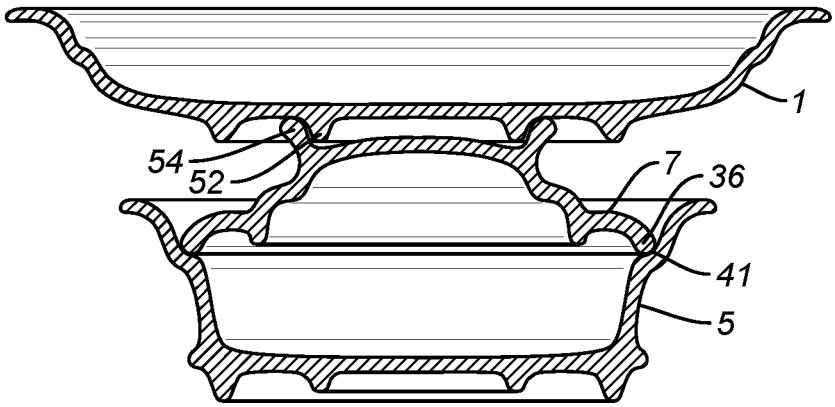
FIG. 2D shows a cross section of the DINNER PLATE (1) resting on top of an inverted SAUCER (7), which here is serving as a lid on top of the SIDE DISH. (5)

FIG. 2D shows a cross section of the DINNER PLATE (1) resting on top of an inverted SAUCER (7), which here is serving as a lid on top of the SIDE DISH (5) (but similarly could be serving as a lid on top of the CEREAL BOWL). This figure demonstrates how the Beta-Ring Footing (52) of the DINNER PLATE (1) fits into the Medium-Flared Pedestal Footing (54) of the inverted SAUCER (7), allowing for a stable stacking configuration. The figure also demonstrates how the Interior Raised Ledge of the SIDE DISH (41) accommodates the Rim of the SAUCER (36) to form a lidded-container.

Figure 2E:
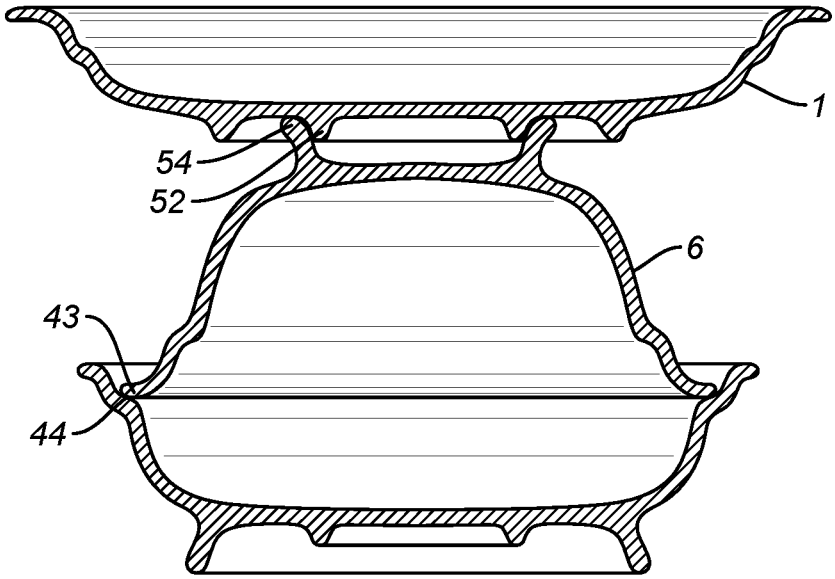
FIG. 2E shows a cross section of the DINNER PLATE (1) resting on top of an inverted CEREAL BOWL (6), which here is serving as a lid on top of the PASTA BOWL. (3)

FIG. 2E shows a cross section of the DINNER PLATE (1) resting on top of an inverted CEREAL BOWL (6) which is serving as a lid on top of the PASTA BOWL (3) (but similar could be serving as a lid on top of the SALAD PLATE). The figures show how the Beta-Ring Footing (52) of the DINNER PLATE (1) fits into the Medium-Flared Pedestal Footing of the CEREAL BOWL (54) of the inverted CEREAL BOWL (6), and how the Interior Raised Ledge of the PASTA BOWL (44) accommodate the Rim of the SIDE DISH (43) to form a lidded-container.

Figure 3:
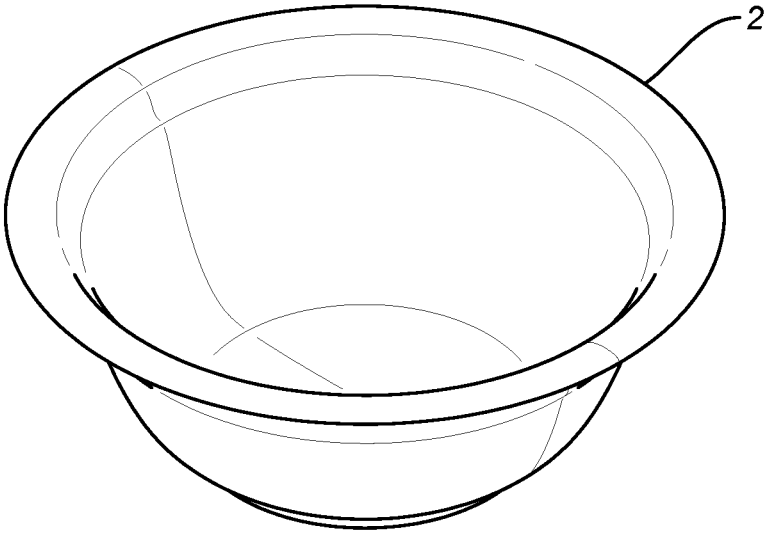
FIG. 3 shows the DEEP-DISH SERVER (2) alone.

Now looking at FIG. 3, a DEEP-DISH SERVER (2) is shown alone. FIGS. 3A through D show various configuration featuring the functionality of the DEEP-DISH SERVER (2) in different stacking and lidded configurations.

Figure 3A:
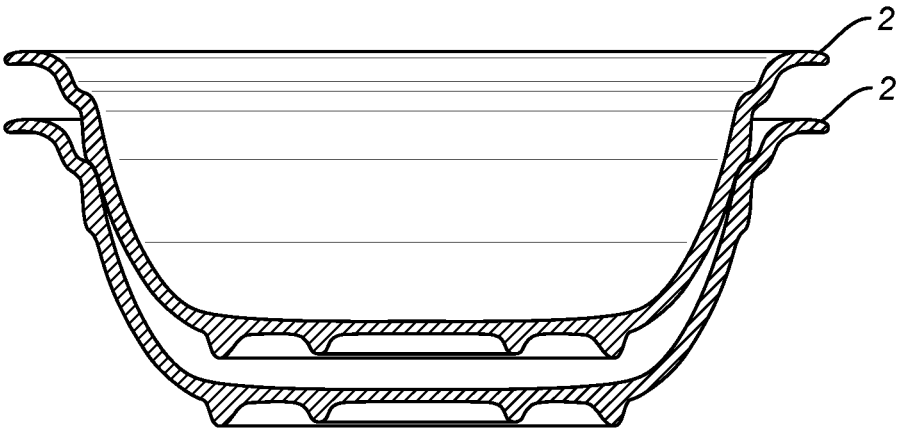
FIG. 3A shows a cross section of the DEEP-DISH SERVER (2) stacked on top of another DEEP-DISH SERVER. (2)

FIG. 3A shows a cross section of the DEEP-DISH SERVER (2) stacked on top of another DEEP-DISH SERVER (2). The DEEP-DISH SERVER (2) is designed to nest with the other DEEP-DISH SERVERS (2) when storing these dishes on their own.

Figure 3B:
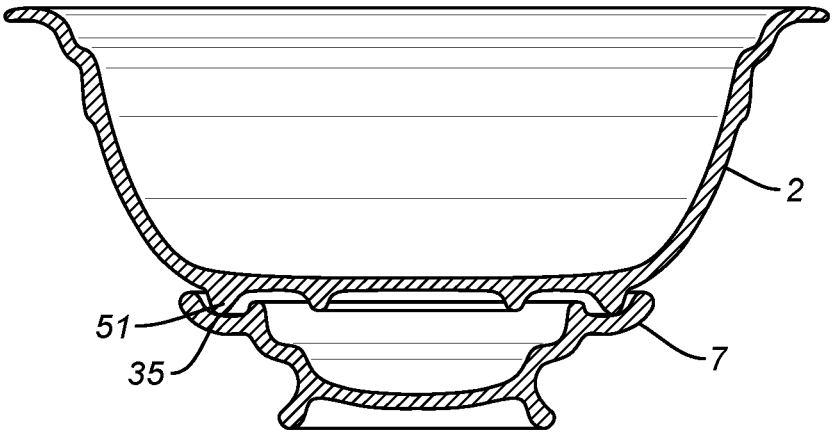
FIG. 3B shows a cross section of the DEEP-DISH SERVER (2) stacked on top stacked on top of the SAUCER (7) being used as a trivet or pedestal.

FIG. 3B shows the cross section of the DEEP-DISH SERVER (2) stacked on top of the SAUCER (7) being used as a trivet or pedestal. The Alpha-Ring Footing (51) of the DEEP-DISH SERVER (2) settles stably into place along the Scalloped Lip of the SAUCER. (35)

Figure 3C:
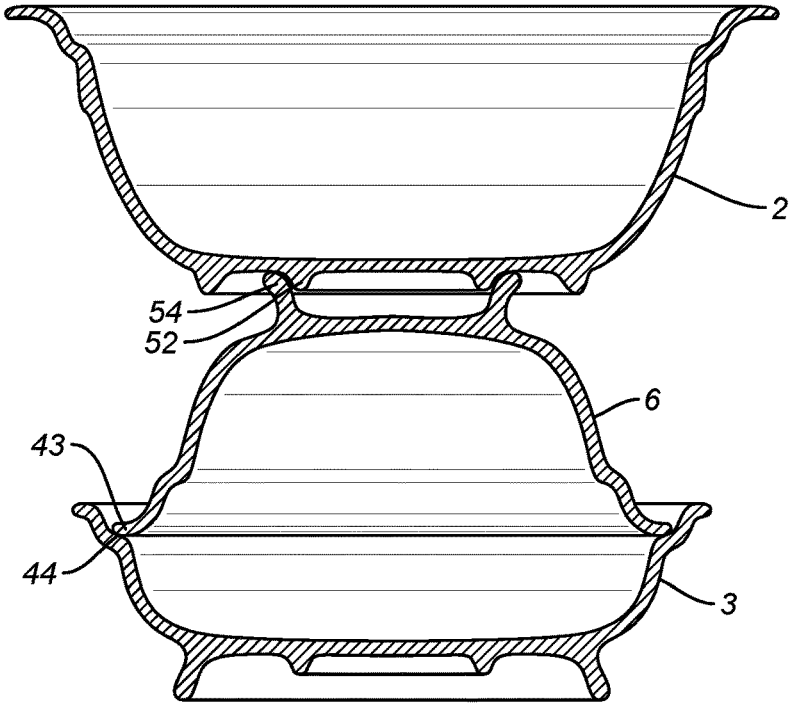
FIG. 3C shows a cross section of the DEEP-DISH SERVER (2) resting on top of an inverted CEREAL BOWL (6), which here is serving as a lid on top of the PASTA BOWL. (3)

FIG. 3C shows a cross section of the DEEP-DISH SERVER (2) resting on top of an inverted CEREAL BOWL (6), here serving as a lid on top of the PASTA BOWL (3). The figures show how the Beta-Ring Footing (52) of the DEEP-DISH SERVER (2) fits into the Medium-Flared Pedestal Footing of the CEREAL BOWL (54), allowing for additional stacking configurations. As a side note, and in the preferred embodiment, Medium-Flared Pedestal Footing of the CEREAL BOWL (54) is functionally the same as Medium-Flared Pedestal Footing of the SAUCER (54), so the DEEP-DISH SERVER (2) could also rest on top of the SAUCER. (7) The figure also demonstrates how the Interior Raised Ledge of the PASTA BOWL (44) accommodate the Rim of the CEREAL BOWL (43) to form a lidded-container.

Figure 3D:
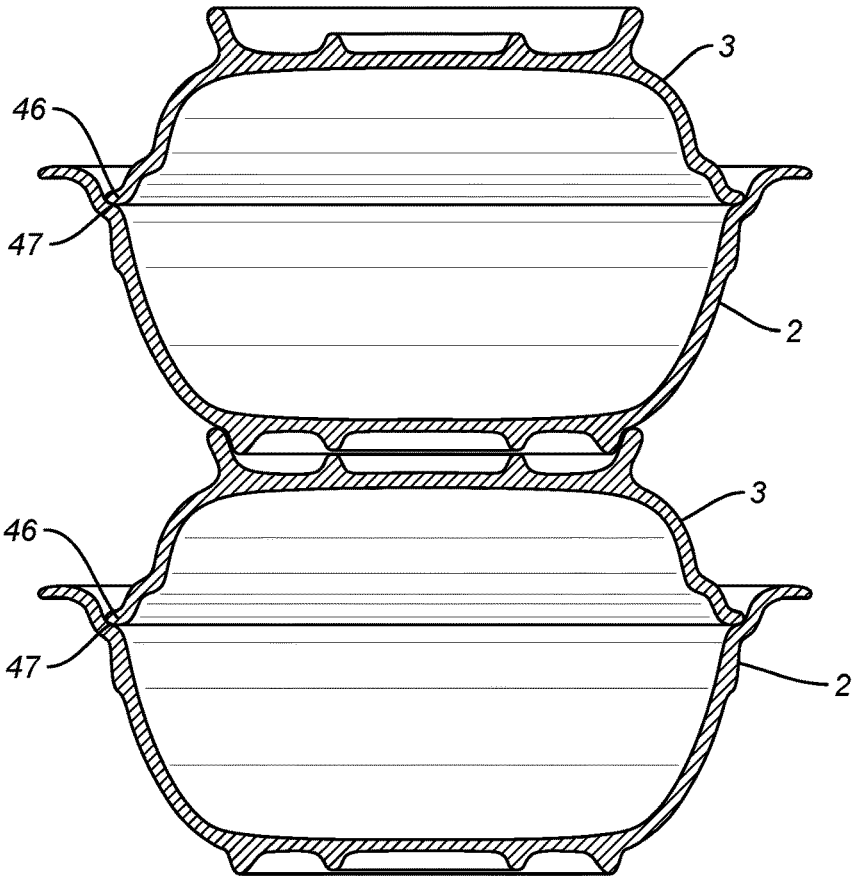
FIG. 3D shows a cross section of the DEEP-DISH SERVER (2) being covered by the PASTA BOWL (3), flipped over to serve as a lid, stacked on top of another DEEP-DISH SERVER (2) and PASTA BOWL (3) in the same configuration.

FIG. 3D shows a cross section of the DEEP-DISH SERVER (2) being covered by the PASTA BOWL (3), flipped over to serve as a lid, stacked on top of another DEEP-DISH SERVER (2) and PASTA BOWL (3) in the same configuration. The figure demonstrates how the Interior Raised Ledge of the DEEP-DISH SERVER (47) accommodates the Rim of the inverted PASTA BOWL (46) to form a lidded-container and also shows how the distal portion Alpha-Ring Footing (51) of the DEEP-DISH SERVER (2) settles into the Large-Flared Pedestal Footing of the PASTA BOWL (53), allowing these two lidded-containers to be stably stacked on top of each other.

Figure 4:
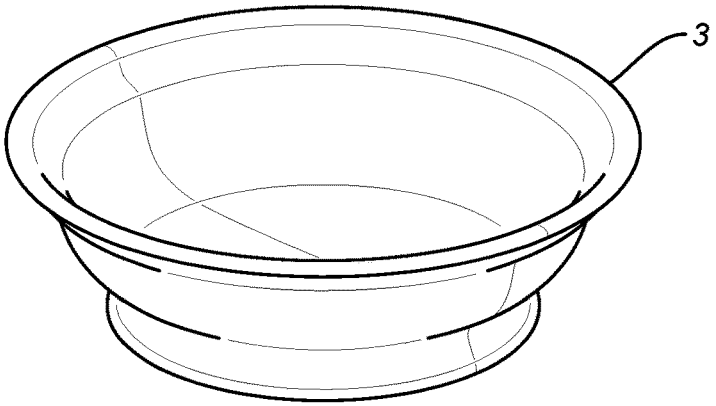
FIG. 4 shows the PASTA BOWL (3) alone.

FIG. 4 shows the PASTA BOWL (3) alone. FIGS. 4A through F show various configurations featuring the functionality of the PASTA BOWL (3) in different stacking and lidded configurations.

Figure 4A:
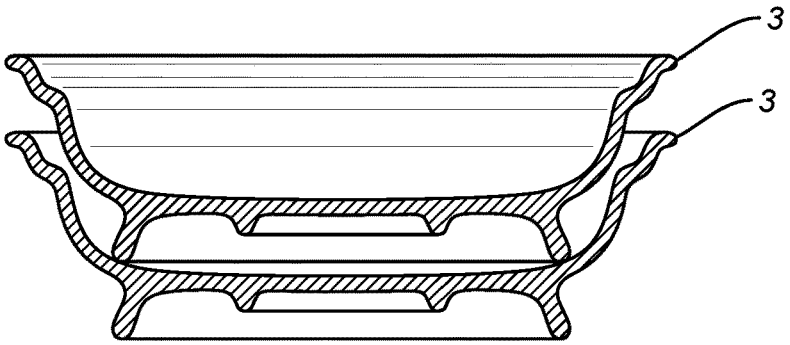
FIG. 4A shows a cross section of the PASTA BOWL (3) stacked on top of another PASTA BOWL (3).

FIG. 4A shows a cross section of the PASTA BOWL (3) stacked on top of another PASTA BOWL (3). The PASTA BOWL (3) is designed to nest with other PASTA BOWLS. (3)

Figure 4B:
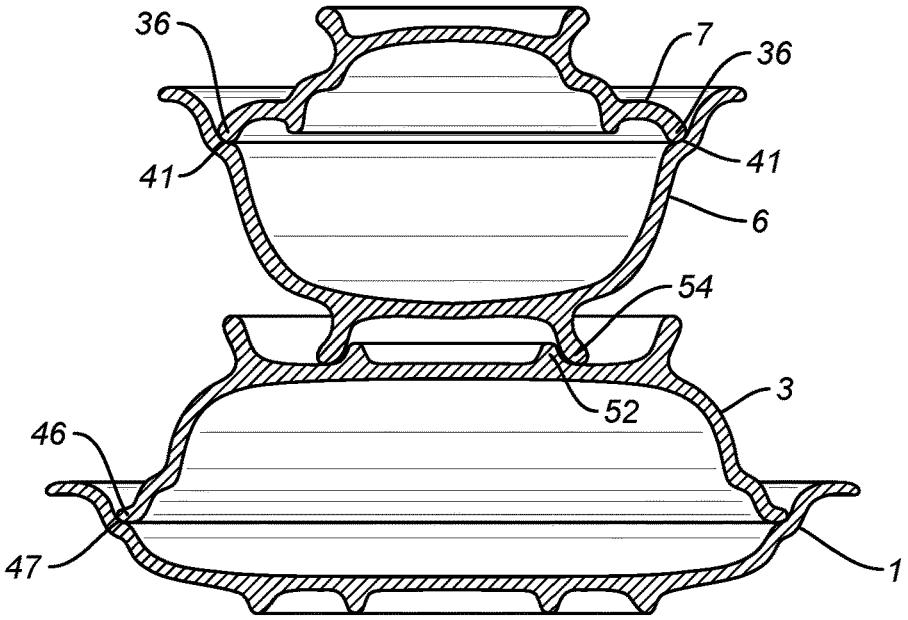
FIG. 4B (from bottom to top) shows a cross section of the DINNER PLATE (1) being covered by the PASTA BOWL (3), flipped over to serve as a lid, and stacked on top of said PASTA BOWL (3) is a CEREAL BOWL (6) with a SAUCER (7) serving as a lid to said CEREAL BOWL. (6)

FIG. 4B (from bottom to top) shows a cross section of the DINNER PLATE (1) being covered by the PASTA BOWL (3), flipped over to serve as a lid, and stacked on top of said PASTA BOWL (3) is a CEREAL BOWL (6) with a SAUCER (7) serving as a lid to said CEREAL BOWL. (6) This figure demonstrates how the Interior Raised Ledge of the DINNER PLATE (47) accommodates the Rim of the PASTA BOWL (46) (when inverted to serve as a lid), such that the two dishes fit together to form a lidded-container; and the figure also demonstrates how the Medium-Flared Pedestal Footing of the CEREAL BOWL (54) fits stably on the Beta-Ring Footing (52) of the PASTA BOWL (3); and finally, the figure demonstrates how the Interior Raised Ledge of the CEREAL BOWL (41) accommodates the Rim of the SAUCER (36) when the SAUCER (7) is inverted and serving as a lid to form another lidded-container.

Figure 4C:
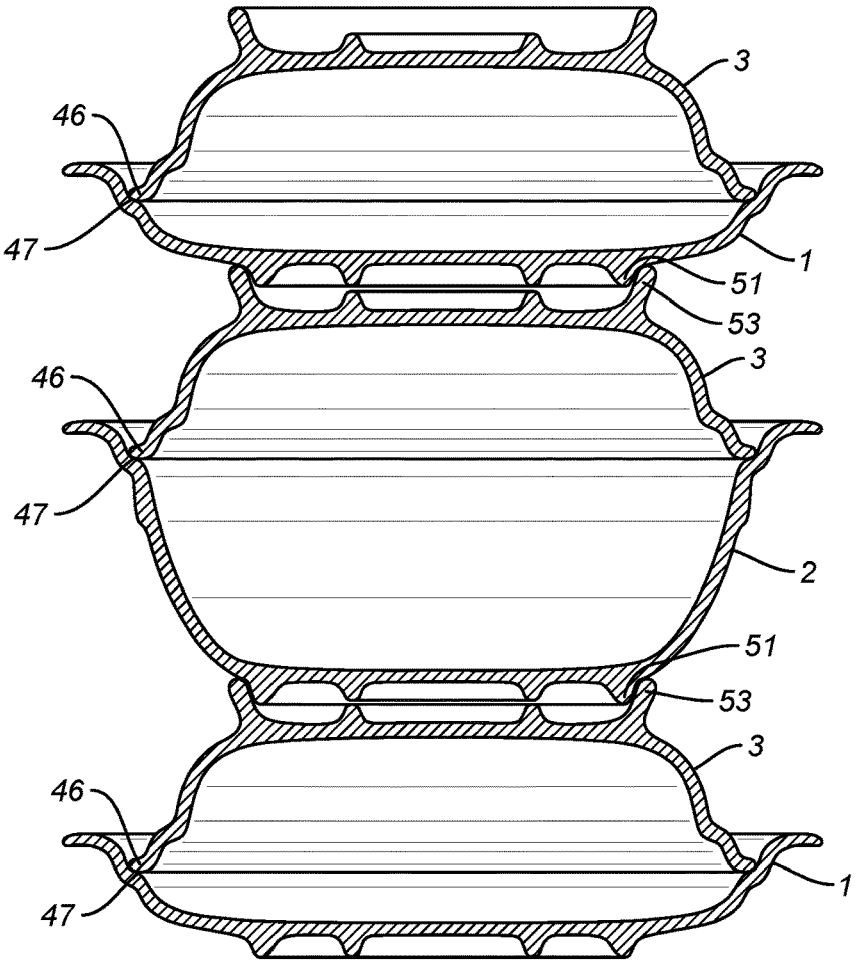
FIG. 4C shows a cross section (from bottom to top) of the DINNER PLATE (1) being covered by the PASTA BOWL (3), flipped over to serve as a lid, with a DEEP-DISH SERVER (2) and PASTA BOWL (3) lidded-container configuration stacked similarly on top, and finally, another DINNER PLATE (1) and PASTA BOWL (3) lidded-container configuration stacked similarly on top.

FIG. 4C shows a cross section (from bottom to top) of the DINNER PLATE (1) being covered by the PASTA BOWL (3), flipped over to serve as a lid, with a DEEP-DISH SERVER (2) and PASTA BOWL (3) lidded-container configuration stacked similarly on top, and finally, another DINNER PLATE (1) and PASTA BOWL (3) lidded-container configuration stacked similarly on top. The figure demonstrates how both the Interior Raised Ledge of the DINNER PLATE (47) and Interior Raised Ledge of the DEEP-DISH SERVER (47) are proportionally equivalent (and labeled with the same number), and Rim of the PASTA BOWL (46) settles stably upon this Interior Raised Ledge (47), serving as a lid to both the DINNER PLATE (1) and DEEP-DISH SERVER (2) interchangeably. This FIG. 4C also shows how the DINNER PLATE (1) and DEEP-DISH SERVER (2) fit onto the top of the inverted PASTA BOWL (3), the Alpha-Ring Footing (51), being both on the DINNER PLATE (1) and the DEEP-DISH SERVER (2), settles stably into the Large-Flared Pedestal Footing of the PASTA BOWL (53), allowing these lidded-containers to be stacked on top of each other.

Figure 4D:
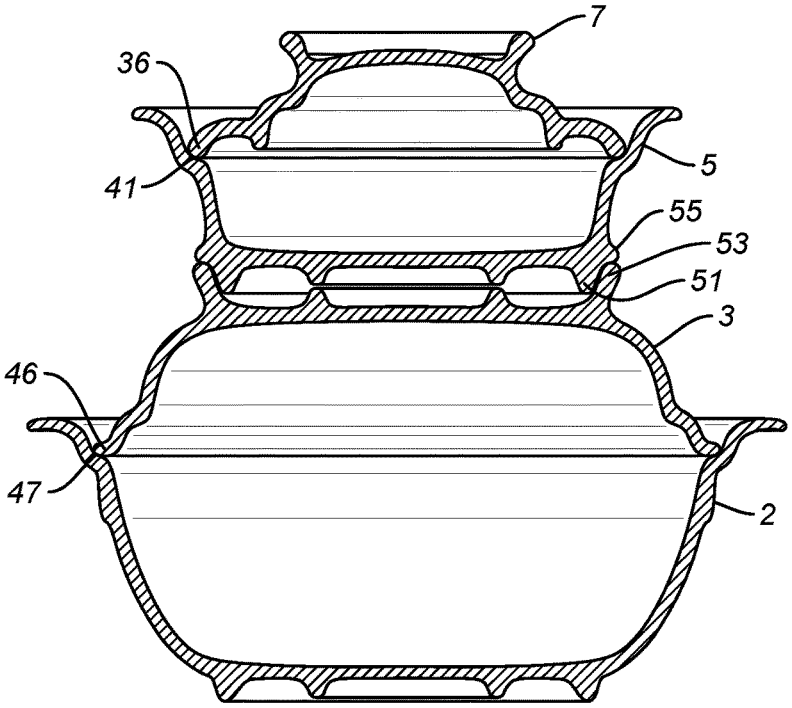
FIG. 4D shows a cross section (from bottom to top) of the DEEP-DISH SERVER (2) being covered by the PASTA BOWL (3), flipped over to serve as a lid, with a SIDE DISH (5) and SAUCER (7) lidded-container configuration stacked on top.

FIG. 4D shows a cross section (from bottom to top) of the DEEP-DISH SERVER (2) being covered by an inverted PASTA BOWL (3) in a lidded-container configuration, with a SIDE DISH (5) and an inverted SAUCER (7) in another lidded-container configuration stacked on top. The figure demonstrates how the alpha ring (51) footing of the SIDE DISH (5) fits into the wide-flared footing (53) of the inverted PASTA BOWL (3), allowing these lidded-containers to be stacked firmly on top of each other.

Figure 4E:
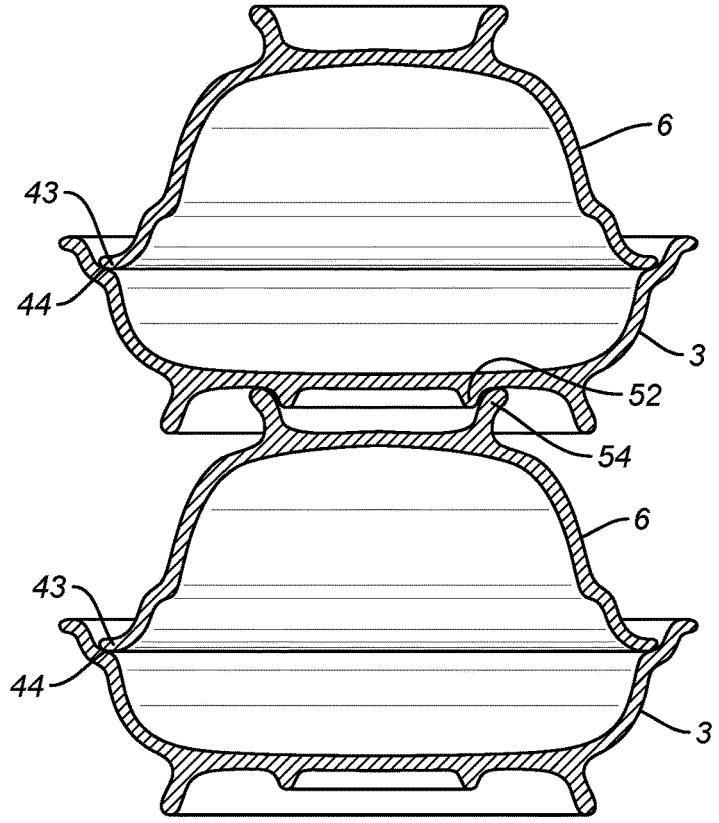
FIG. 4E shows a cross section (from bottom to top) of the PASTA BOWL (3) being covered by the CEREAL BOWL (6) (inverted as lid), with another PASTA BOWL (3) being covered by another CEREAL BOWL (6), the same lidded-container configuration, stacked on top.

FIG. 4E shows a cross section (from bottom to top) of the PASTA BOWL (3) being covered by the CEREAL BOWL (6) (inverted as lid), with another PASTA BOWL (3) being covered by another CEREAL BOWL (6), both in the same lidded-container configuration, stacked on top. The figure demonstrates how the Interior Raised Ledge of the PASTA BOWL (44) accommodates the Rim of the CEREAL BOWL (43) to form a lidded-container. Additionally, the figure demonstrates how the recessed Beta-Ring Footing (52) of the PASTA BOWL (3) fits into the Medium-Flared Pedestal Footing of the CEREAL BOWL (54), allowing these lidded-containers to be stacked firmly on top of each other.

Figure 4F:
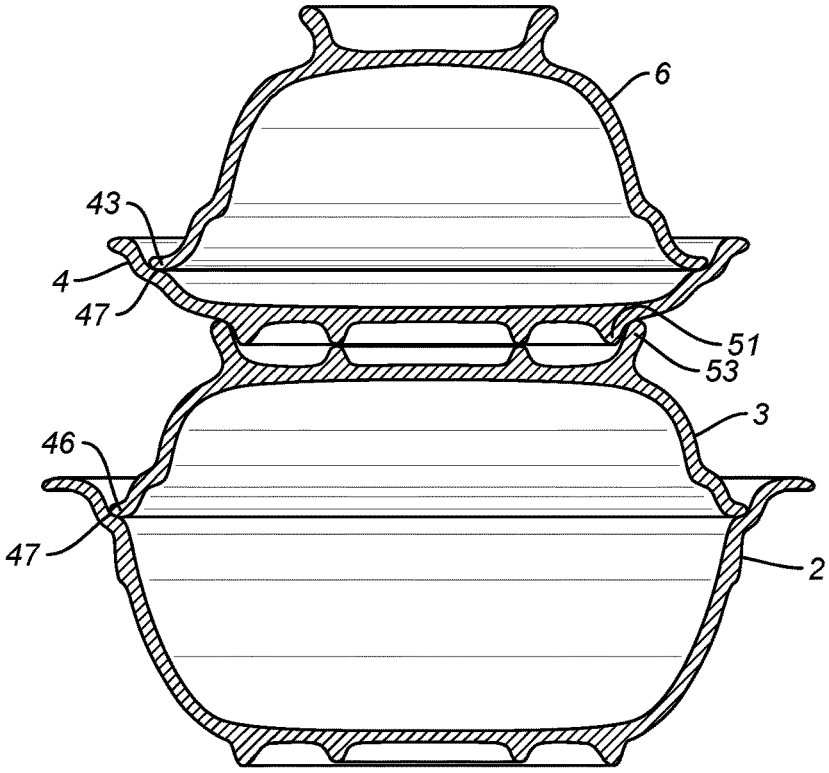
FIG. 4F shows a cross section (from bottom to top) of the DEEP-DISH SERVER (2) being covered by the PASTA BOWL (3), with a SALAD PLATE (4) and CEREAL BOWL (6) lidded-container configuration stacked on top.

FIG. 4F shows a cross section (from bottom to top) of the DEEP-DISH SERVER (2) being covered by the inverted PASTA BOWL (3) to form a lidded-container configuration, with a SALAD PLATE (4) being covered by the inverted CEREAL BOWL (6) lidded-container configuration stacked on top. The figure demonstrates how Alpha-Ring Footing (51) of the SALAD PLATE (4) fits into the Large-Flared Pedestal Footing of the PASTA BOWL (53), allowing the upper lidded-container configuration to be stacked firmly on top of the bottom lidded-container configuration.

Figure 5:
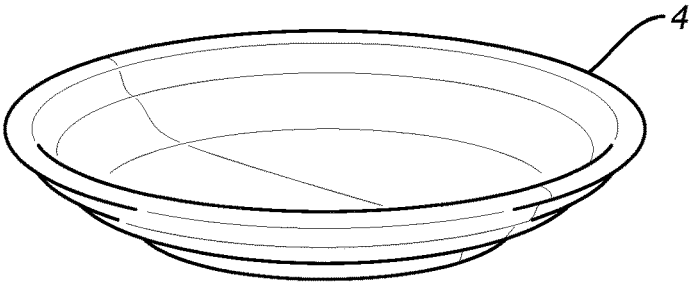
FIG. 5 shows the SALAD PLATE (4) alone.

FIG. 5 shows the SALAD PLATE (4) alone. FIGS. 5A-D show various configurations featuring the functionality of the SALAD PLATE (4) in different stacking and lidded configurations.

Figure 5A:
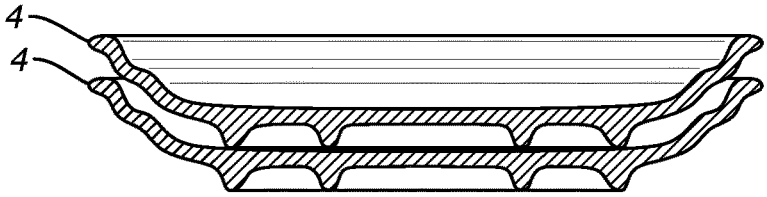
FIG. 5A shows a cross section of the SALAD PLATE (4) stacked on top of another SALAD PLATE. (4)

FIG. 5A shows a cross section of the SALAD PLATE (4) stacked on top of another SALAD PLATE. (4) This figure demonstrates how the SALAD PLATE. (4) is designed to nest with other SALAD PLATES. (4)

Figure 5B:
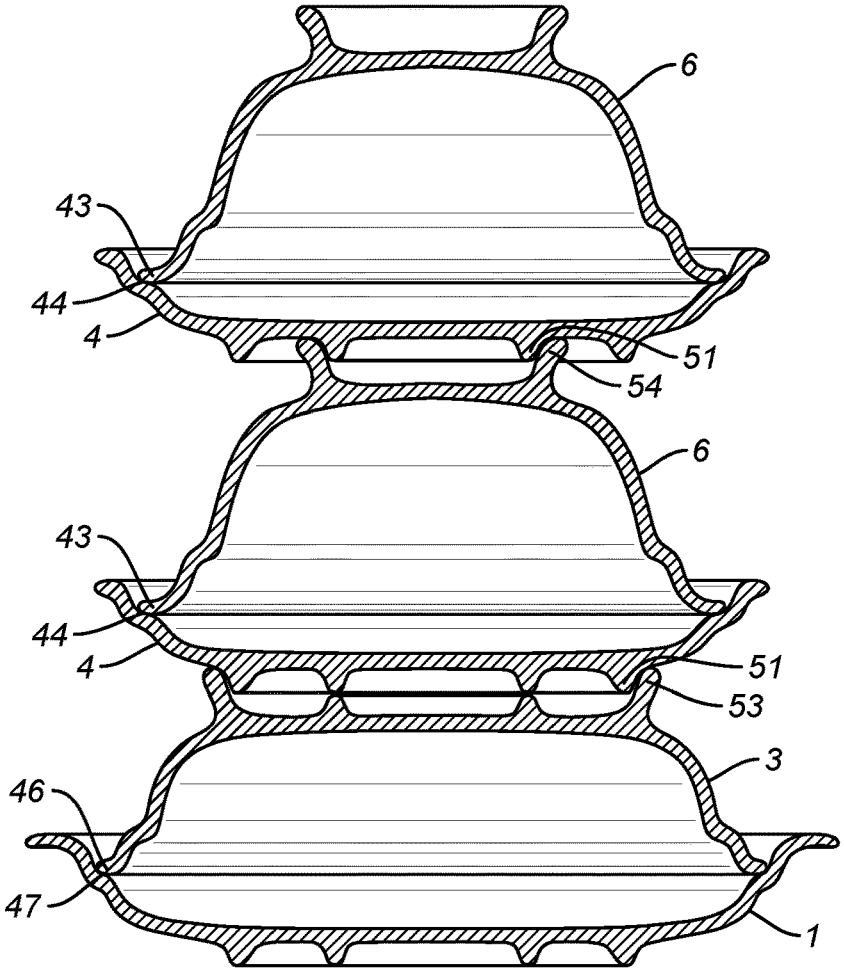
FIG. 5B shows a cross section (from bottom to top) of the DINNER PLATE (1) being covered by the PASTA BOWL (3), flipped over to serve as a lid, with the SALAD PLATE (4) being covered by the CEREAL BOWL (6) (inverted as lid), with another SALAD PLATE (4) being covered by the CEREAL BOWL (6), the same lidded-container configuration, stacked on top.

FIG. 5B shows a cross section (from bottom to top) of the DINNER PLATE (1) being covered by the inverted PASTA BOWL (3), flipped over to serve as a lid, with the SALAD PLATE (4) being covered by the CEREAL BOWL (6) (inverted and used as a lid), with another SALAD PLATE (4) being covered by the CEREAL BOWL (6), the same lidded-container configuration, stacked on top. This figure demonstrates how the Interior Raised Ledge of the DINNER PLATE (47) accommodates the Rim of the PASTA BOWL (46) when inverted to serve as a lid, such that the two dishes fit together to form a lidded-container; this figure also demonstrates how Alpha-Ring Footing (51) of the SALAD PLATE (4) fits into the Large-Flared Pedestal Footing of the PASTA BOWL (53), allowing the upper lidded-container configuration to be stacked firmly on top; additionally, this figure demonstrates how the Interior Raised Ledge of the SALAD PLATE (44) accommodates the Rim of the CEREAL BOWL (43) when it is inverted as a lid to form a lidded-container; finally, the figure demonstrates how the Beta-Ring Footing (52) of the SALAD PLATE (4) fits into the Medium-Flared Pedestal Footing of the CEREAL BOWL when inverted as a lid, allowing these lidded-containers to be stacked firmly on top of each other.

Figure 5C:
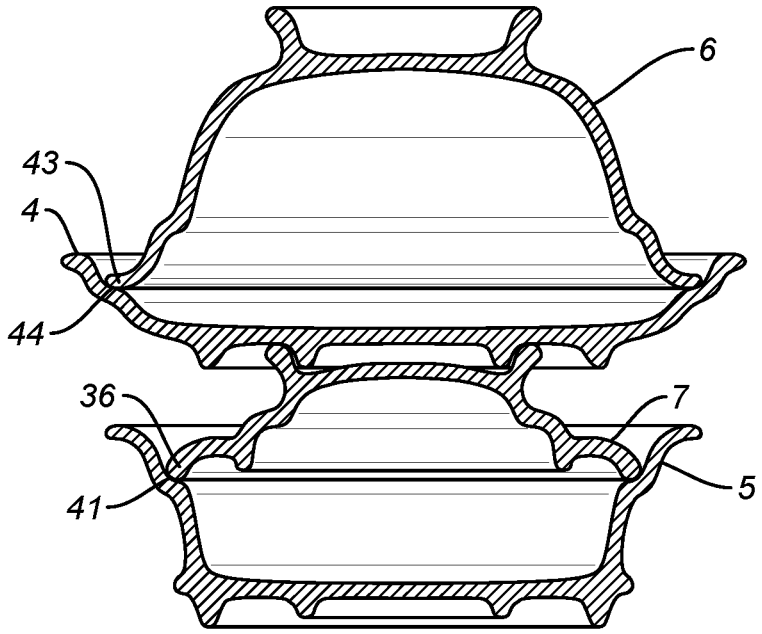
FIG. 5C shows a cross section (from bottom to top) of the SIDE DISH (5) being covered by the SAUCER (7), which is flipped over to serve as a lid, then stacked on this, the SALAD PLATE (4) being covered by the CEREAL BOWL (6) (inverted as lid).

FIG. 5C shows a cross section (from bottom to top) of the SIDE DISH (5) being covered by the SAUCER (7), which is flipped over to serve as a lid, then stacked on this, the SALAD PLATE (4) being covered by the CEREAL BOWL (6) (inverted as lid). The figure demonstrates how Interior Raised Ledge of the SIDE DISH (41) accommodates the Rim of the inverted SAUCER (36) to form a lidded-container; further, the figure demonstrates how the Interior Raised Ledge of the SALAD PLATE (44) accommodates the Rim of the inverted CEREAL BOWL (43) to form a lidded-container; finally, the figure shows how the Beta-Ring Footing (52) of the SALAD PLATE (4) fits into the Medium-Flared Pedestal Footing of the inverted SAUCER (54), allowing these two lidded-containers to be stacked firmly on top of each other.

Figure 5D:
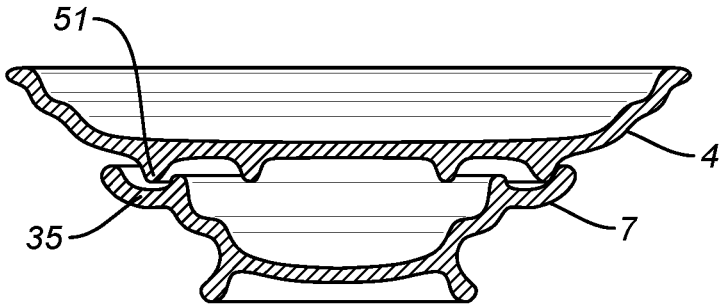
FIG. 5D shows a cross section of the SALAD PLATE (2) stacked on top stacked on top of the SAUCER (7) being used as a trivet or pedestal.

FIG. 5D shows the cross section of the SALAD PLATE (4) stacked on top of the SAUCER (7), being used as a trivet or pedestal. The Alpha-Ring Footing (51) of the SALAD PLATE (4) settles stably into place along the Scalloped Lip of the SAUCER. (35)

Figure 6:
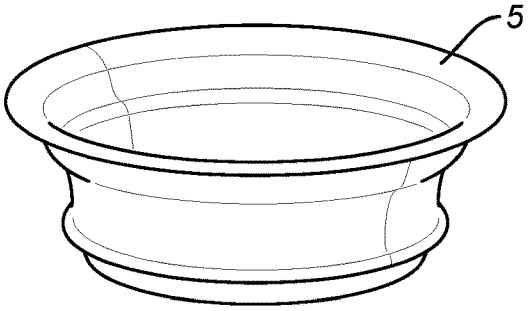
FIG. 6 shows the SIDE DISH (5) alone.

FIG. 6 shows the SIDE DISH (5) alone. FIGS. 6A-D show various configurations featuring the functionality of the SIDE DISH (5) in different stacking and lidded configurations.

Figure 6A:
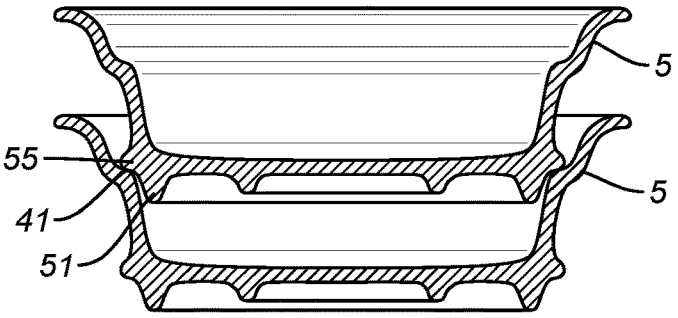
FIG. 6A shows a cross section of the SIDE DISH (5) stacked on top of another SIDE DISH. (5)

FIG. 6A shows a cross section of the SIDE DISH (5) stacked on top of another SIDE DISH. (5) The Protruding Exterior Ledge (at the base) of the SIDE DISH (55) above settles onto the Interior Raised Ledge of the SIDE DISH (41) below when these pieces are stacked on top of each other for storage.

Figure 6B:
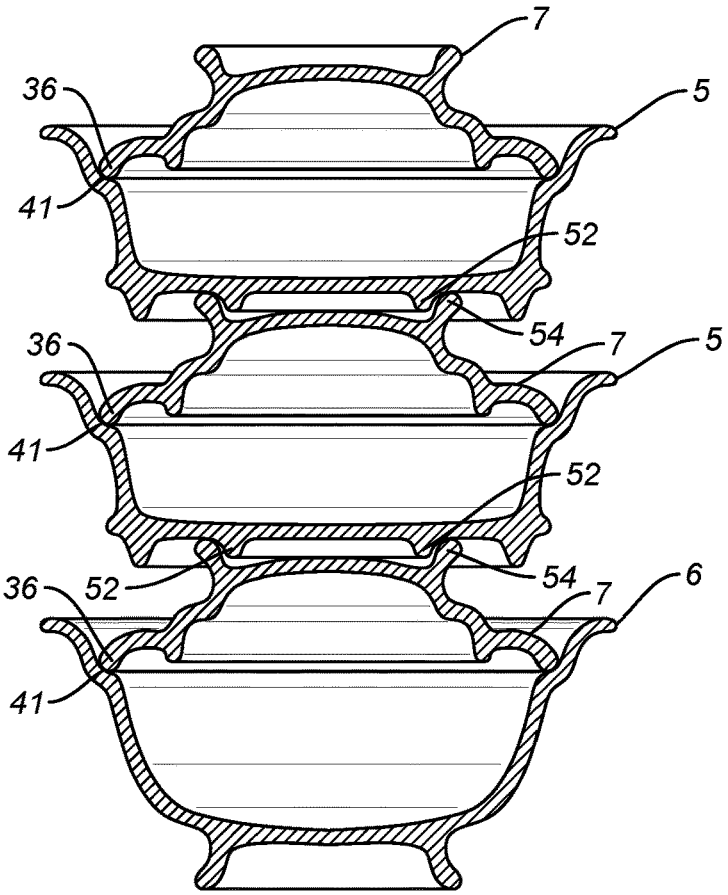
FIG. 6B shows a cross section (from bottom to top) of the CEREAL BOWL (6) being covered by the SAUCER (7), flipped over to serve as a lid, this first lidded-container topped by the SIDE DISH (5) being covered by the SAUCER (7), again flipped over to serve as a lid, then stacked on this, the same lidded configuration, another SIDE DISH (5) being covered by the SAUCER (7), flipped over to serve as a lid.

FIG. 6B shows a cross section (from bottom to top) of the CEREAL BOWL (6) being covered by the SAUCER (7), flipped over to serve as a lid, this first lidded-container topped by the SIDE DISH (5) being covered by the SAUCER (7), again flipped over to serve as a lid, then stacked on this, the same lidded configuration, another SIDE DISH (5) being covered by an inverted SAUCER. (7) The figure demonstrates how the Interior Raised Ledge of the SIDE DISH (41) and the Interior Raised Ledge of the CEREAL BOWL (41) are the proportionally equivalent (and thus share the same numbered designation of 41), both accommodating the Rim of the SAUCER (36) to form two different-sized containers. Additionally, the figure demonstrates how Beta-Ring Footing (52) of the SIDE DISH (5) fits into the Medium-Flared Pedestal Footing of the SAUCER (54), allowing these lidded-containers to be stacked firmly on top of each other.

Figure 6C:
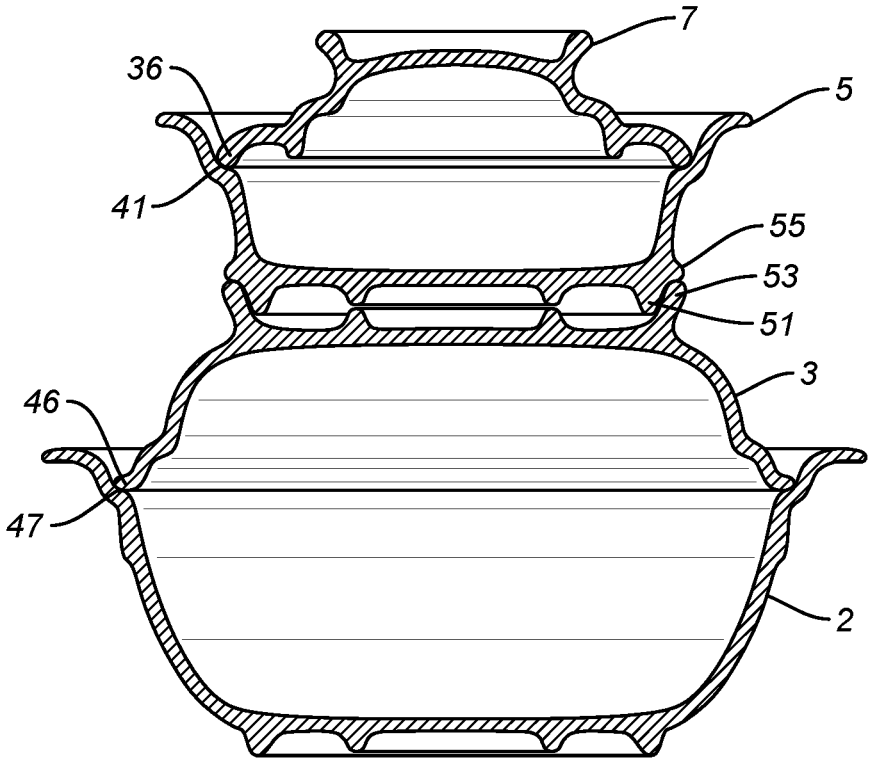
FIG. 6C shows a cross section (from bottom to top) of the DEEP-DISH SERVER (2) being covered by the PASTA BOWL (3), with a SIDE DISH (5) and SAUCER (7) lidded-container configuration stacked on top.

FIG. 6C shows a cross section (from bottom to top) of the DEEP-DISH SERVER (2) being covered by the PASTA BOWL (3), with a SIDE DISH (5) and SAUCER (7) lidded-container configuration stacked on top. This figure demonstrates how the Interior Raised Ledge of the DEEP-DISH SERVER (47) accommodate the Rim of the inverted PASTA BOWL (46) to form a lidded-container; it further demonstrates the Alpha-Ring Footing (51) of the SIDE DISH (5) settle into the Large-Flared Pedestal Footing of the inverted PASTA BOWL (53), allowing the two lidded container to stack stably, including contact with the Protruding Exterior Ledge. (55) Finally, this figure demonstrates how the Interior Raised Ledge of the SIDE DISH (41) accommodate the Rim of the SAUCER (36) to form the upper lidded-container.

Figure 6D:
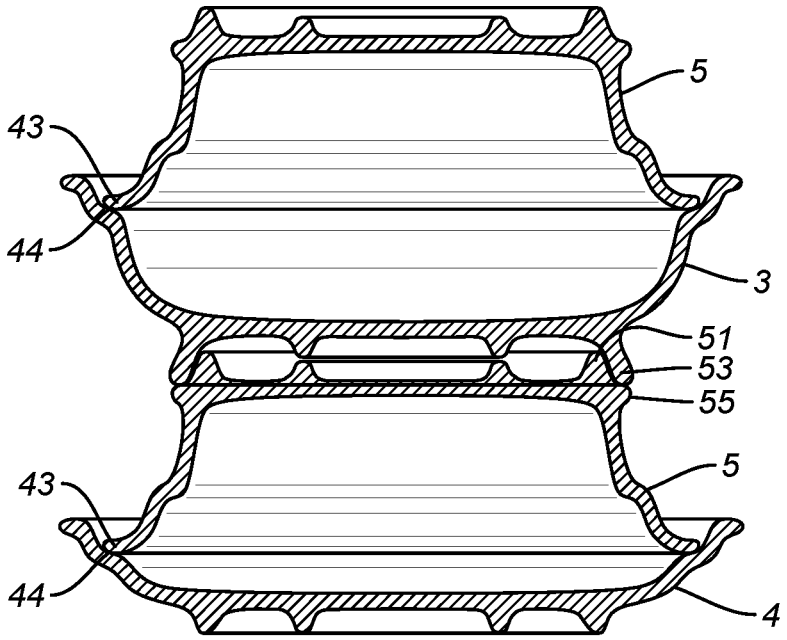
FIG. 6D shows a cross section (from bottom to top) of the SALAD PLATE (4) being covered by the SIDE DISH (5), with a PASTA BOWL (3) and SIDE DISH (5) lidded-container configuration stacked on top.

FIG. 6D shows a cross section (from bottom to top) of the SALAD PLATE (4) being covered by the inverted SIDE DISH (5), with a PASTA BOWL (3) and SIDE DISH (5) lidded-container configuration stacked on top. This figure demonstrates how Interior Raised Ledge of the PASTA BOWL (44) and the Interior Raised Ledge of the SALAD PLATE (44) are proportionally equivalent (and thus share the same numerical designation of 44), allowing for the inverted SIDE DISH (5) to serve as a lid on both interchangeably to form two different-sized lidded-containers. (For comparison, the Rim of the SIDE DISH (43) and the Rim of the CEREAL BOWL (43) are also proportionally equivalent, which means that both can serve as lids on the PASTA BOWL (3) or SALAD PLATE (4) interchangeably—the next two figures shows how the CEREAL BOWL (6) functions similarly to the SIDE DISH (5) as a lid on top of the PASTA BOWL (3) or SALAD PLATE (4) to form two more different-sized lidded-containers). Additionally, this figures demonstrates how the PASTA BOWL (3) can be set up on the SIDE DISH (5) when it is inverted serving as a lid: the Large-Flared Pedestal Footing of the PASTA BOWL (53) fit over the Alpha-Ring Footing (51) of the inverted SIDE DISH (5) Protruding Exterior Ledge (at the base) of the SIDE DISH. (55)

Figure 7:
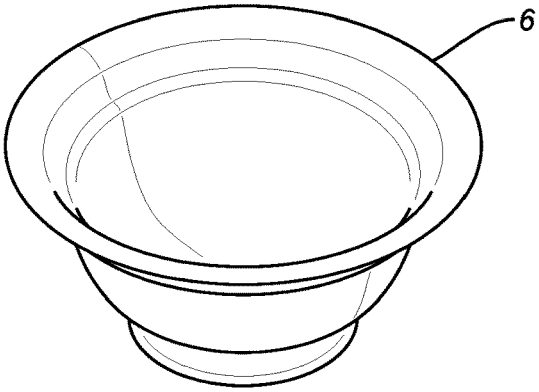
FIG. 7 shows CEREAL BOWL (6) alone.

FIG. 7 shows CEREAL BOWL (6) alone. FIGS. 7A-E show various configurations featuring the functionality of the CEREAL BOWL (6) in different stacking and lidded configurations.

Figure 7A:
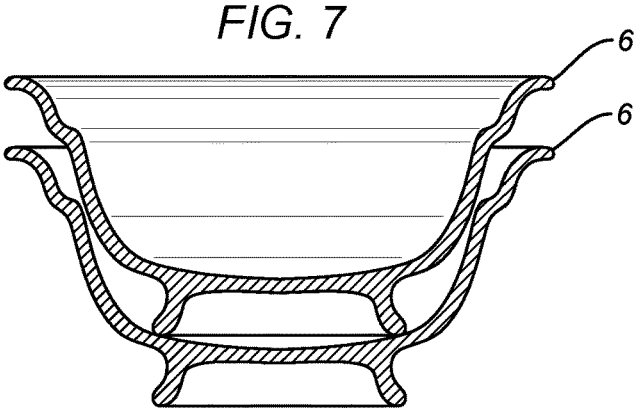
FIG. 7A shows a cross section of the CEREAL BOWL (6) stacked on top the CEREAL BOWL. (6)

FIG. 7A shows a cross section of the CEREAL BOWL (6) stacked on top of a second CEREAL BOWL (6). This figure demonstrates how the CEREAL BOWL (6) is designed to nest with other CEREAL BOWLS (6) when storing.

Figure 7B:
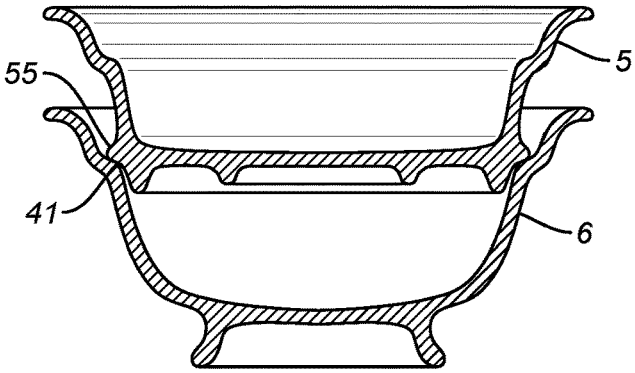
FIG. 7B shows a cross section of the SIDE DISH (5) nested on top the CEREAL BOWL. (6)

FIG. 7B shows a cross section of the SIDE DISH (5) nested on top the CEREAL BOWL. (6) This figure demonstrates the Interior Raised Ledge of the SIDE DISH (41) and the Interior Raised Ledge of the CEREAL BOWL (41) are proportionally equivalent (see FIG. 6A).

Figure 7C:
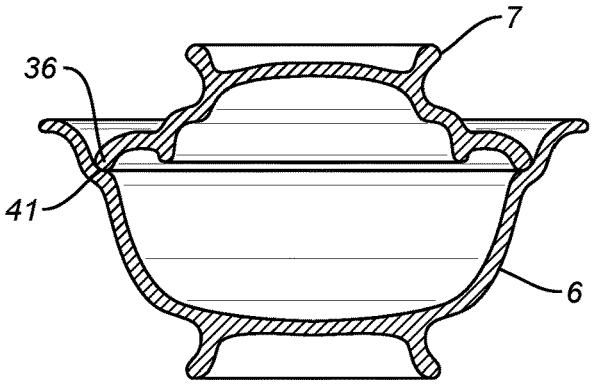
FIG. 7C shows a cross section of the CEREAL BOWL (6) being covered by the SAUCER (7), flipped over to serve as a lid.

FIG. 7C shows a cross section of the CEREAL BOWL (6) being covered by the SAUCER (7), flipped over to serve as a lid. The figure demonstrates how Interior Raised Ledge of the CEREAL BOWL (41) accommodates the Rim of the SAUCER (36) when the SAUCER (7) is inverted and serving as a lid.

Figure 7D:
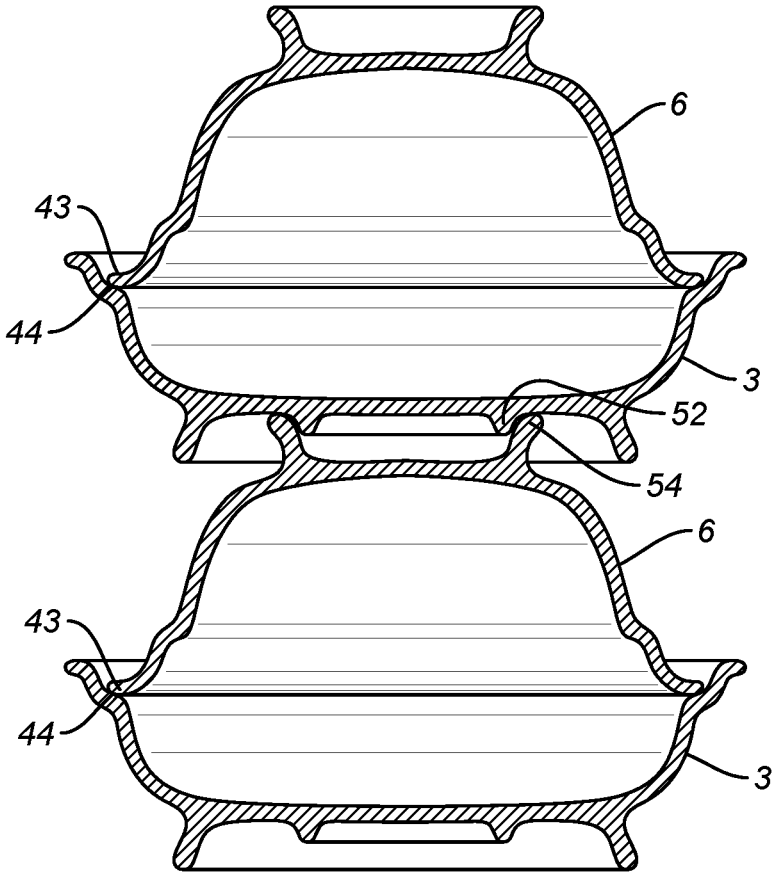
FIG. 7D shows a cross section (from bottom to top) of the PASTA BOWL (3) being covered by the CEREAL BOWL (6) (inverted as lid), with another PASTA BOWL (3) being covered by another CEREAL BOWL (6), the same lidded-container configuration, stacked on top.

FIG. 7D shows a cross section (from bottom to top) of the PASTA BOWL (3) being covered by the CEREAL BOWL (6) (inverted as lid), with another PASTA BOWL (3) being covered by another CEREAL BOWL (6), both in the same lidded-container configuration, stacked on top. The figure demonstrates how the Interior Raised Ledge of the PASTA BOWL (44) accommodates the Rim of the CEREAL BOWL (43) to form a lidded-container. Additionally, the figure demonstrates how the recessed Beta-Ring Footing (52) of the PASTA BOWL (3) fits into the Medium-Flared Pedestal Footing of the CEREAL BOWL (54), allowing these lidded-containers to be stacked firmly on top of each other.

Figure 7E:
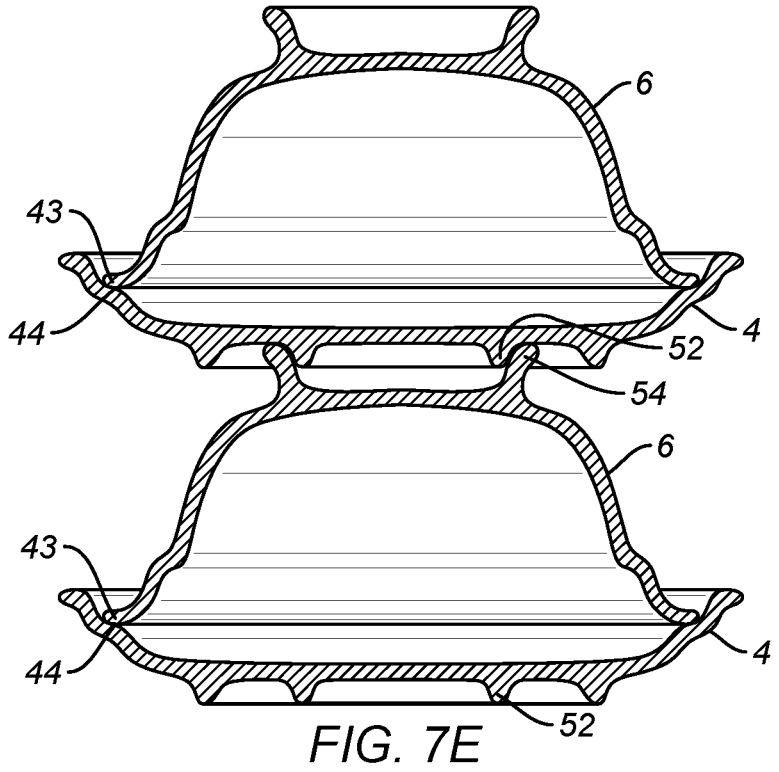
FIG. 7E shows a cross section (from bottom to top) of the SALAD PLATE (4) being covered by the CEREAL BOWL (6) (inverted as lid), then another SALAD PLATE (4) being covered by another CEREAL BOWL (6), this second lidded-container stacked on top.

FIG. 7E shows a cross section (from bottom to top) of the SALAD PLATE (4) being covered by the inverted CEREAL BOWL (6) serving as a lid, then another SALAD PLATE (4) being covered by another inverted CEREAL BOWL (6), this second lidded-container stacked on top. The figure demonstrates this figure demonstrates how the Interior Raised Ledge of the SALAD PLATE (44) accommodates the Rim of the CEREAL BOWL (43) when it is inverted as a lid to form a lidded-container; additionally, the figure demonstrates how the Beta-Ring Footing (52) of the SALAD PLATE (4) fits into the Medium-Flared Pedestal Footing of the CEREAL BOWL when inverted as a lid, allowing these lidded-containers to be stacked stably on top of one another.

Figure 8:
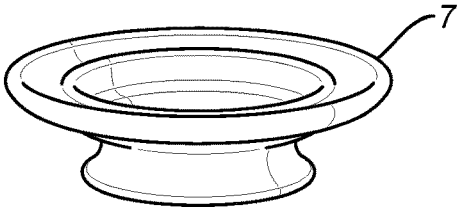
FIG. 8 shows the SAUCER (7) alone.

FIG. 8 shows the SAUCER (7) alone. FIGS. 8A-F show various configurations featuring the functionality of the SAUCER (7) in different stacking and lidded configurations.

Figure 8A:
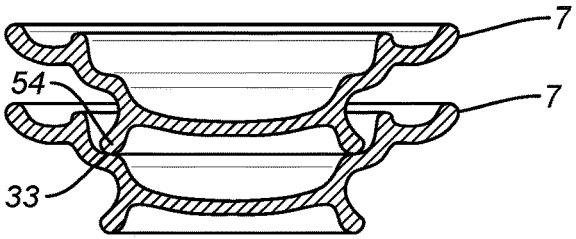
FIG. 8A shows a cross section of the SAUCER (7) stacked on top of another SAUCER. (7)

FIG. 8A shows a cross section of the SAUCER (7) stacked on top of another SAUCER. (7) The figure demonstrates how the Interior Raised Ledge of the SAUCER (33) below accommodates the Medium-Flared Pedestal Footing of the SAUCER (54) above, allowing the SAUCERS (54) to stack on top of each other stably when storing.

Figure 8B:
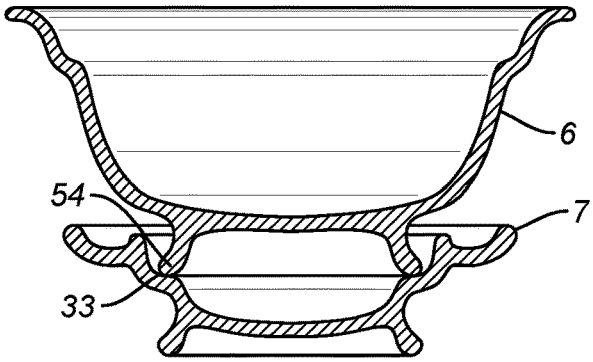
FIG. 8B shows a cross section of the CEREAL BOWL (6) stacked on top of the SAUCER. (7)

FIG. 8B shows a cross section of the CEREAL BOWL (6) stacked on top of the SAUCER. (7) This figure demonstrates how the Interior Raised Ledge of the SAUCER (33) also accommodate the Medium-Flared Pedestal Footing of the CEREAL BOWL (54) since this Medium-Flared Pedestal Footing (54) is the same on both the SAUCER (7) and the CEREAL BOWL (6). As both the Medium-Flared Pedestal Footing of the CEREAL BOWL (54) and the Medium-Flared Pedestal Footing of the SAUCER (54) are proportionally equivalent, they share the same numerical designation of 54.

Figure 8C:
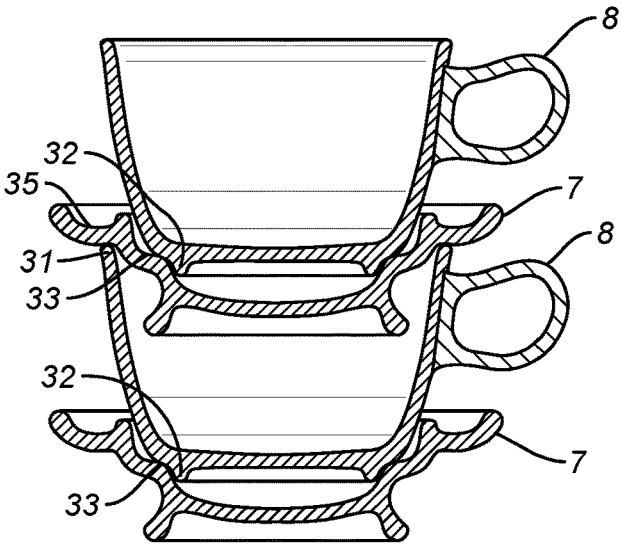
FIG. 8C shows a cross section (From bottom to top) of the SAUCER (7) accommodating the CUP WITH HANDLE (8), and then another SAUCER (7) and CUP WITH HANDLE (8) stacked on top.

FIG. 8C shows a cross section (From bottom to top) of the SAUCER (7) accommodating the CUP WITH HANDLE (8), and then another SAUCER (7) and CUP WITH HANDLE (8) stacked on top. The figure demonstrates how the Gamma-Ring Footing of the CUP WITH HANDLE (32) settles in proximally to the Interior Raised Ledge of the SAUCER (33), allowing the CUP WITH HANDLE (8) to rest stably on the SAUCER; this figure further demonstrates how this SAUCER and CUP WITH HANDLE sets to be stacked on top of each other.

Figure 8D:
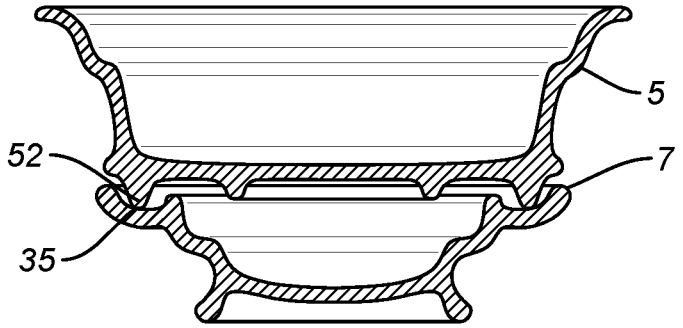
FIG. 8D shows a cross section of the SIDE DISH (5) stacked on top of the SAUCER (7) serving as a trivet.

FIG. 8D shows a cross section of the SIDE DISH (5) stacked on top of the SAUCER (7), being used as a trivet or pedestal. The Alpha-Ring Footing (51) of the SIDE DISH (5) settles stably into place along the Scalloped Lip of the SAUCER (35). (It should be noted that the Alpha-Ring Footing (51) of the DINNER PLATE (1), DEEP-DISH SERVER (2), SALAD PLATE (4), and SIDE DISH (5) in this preferred embodiment are all proportionally equivalent, which allows for the SAUCER (7) to be used as a trivet or pedestal for them all interchangeably).

Figure 8E:
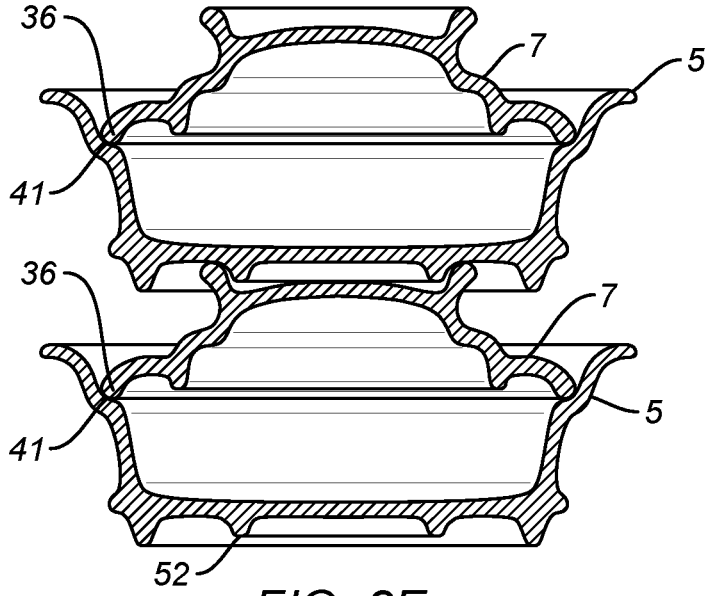
FIG. 8E shows a cross section (from bottom to top) of the SIDE DISH (5) being covered by the SAUCER (7), flipped over to serve as a lid, then stacked on this, the same lidded configuration, another SIDE DISH (5) being covered by the SAUCER (7), flipped over to serve as a lid.

FIG. 8E shows a cross section (from bottom to top) of the SIDE DISH (5) being covered by the SAUCER (7), flipped over to serve as a lid, then stacked on this, the same lidded configuration, another SIDE DISH (5) being covered by an inverted SAUCER (7) serving as a lid. The figure demonstrates how the Beta-Ring Footing (52) of the SIDE DISH (5) fits into the Medium-Flared Pedestal Footing of the inverted SAUCER (54), allowing these lidded-containers to be stacked firmly on top of each other.

Figure 9:
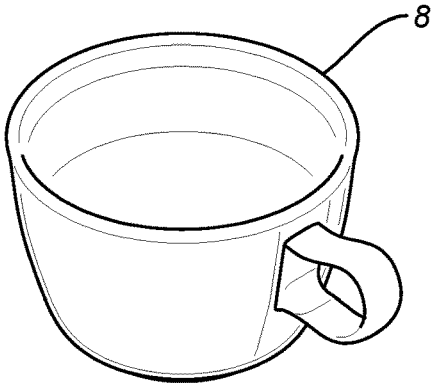
FIG. 9 shows the CUP WITH HANDLE (8) alone.
Figure 9A:
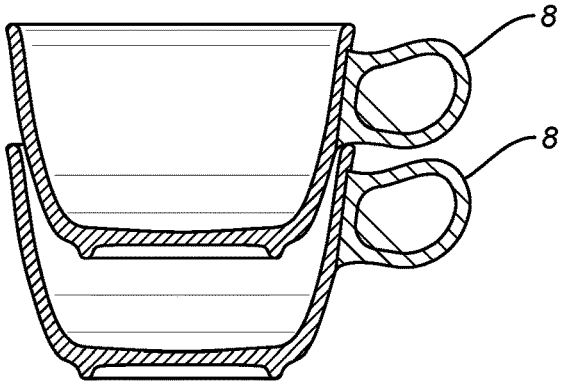
FIG. 9A shows a cross section of the CUP WITH HANDLE (8) nested within another CUP WITH HANDLE. (8)
Figure 9B:
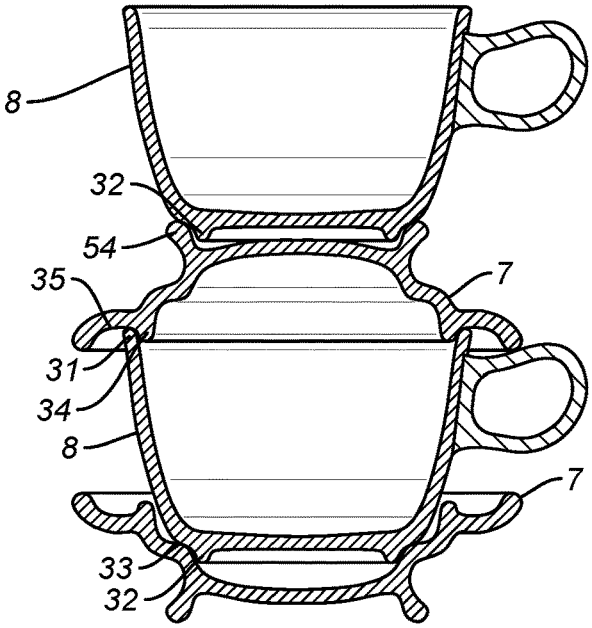
FIG. 9B shows a cross section (From bottom to top) of the SAUCER (7) accommodating the CUP WITH HANDLE (8), and then another SAUCER (7), inverted this time to demonstrate how the saucer can serve as a lid on top of the CUP WITH HANDLE, and then another CUP WITH HANDLE (8) stacked on top.

FIG. 9 shows the CUP WITH HANDLE (8) alone. FIGS. 9A and 9B show various configurations featuring the functionality of the CUP WITH HANDLE (8) in different stacking and nesting configurations.

FIG. 9A shows a cross section of the CUP WITH HANDLE (8) nested within another CUP WITH HANDLE. (8) The CUP WITH HANDLEs (8) are designed to nest with one another.

FIG. 9B shows a cross section (from bottom to top) of the SAUCER (7) accommodating the CUP WITH HANDLE (8) as shown previous in FIG. 8C, and then another SAUCER (7) this time inverted and serving as lid to said CUP WITH HANDLE (8) below and finally another CUP WITH HANDLE (8) stacked on top. The figure demonstrates how the Gamma-Ring Footing of the CUP WITH HANDLE (32) settles in proximally to the Interior Raised Ledge of the SAUCER (33), allowing the CUP WITH HANDLE (8) to rest stably on the SAUCER; this figure further demonstrates how the SAUCER (7) can be flipped over to serve as lid to the CUP WITH HANDLE, the Delta-Ring on the SAUCER (34) settling into the slightly wider Rim of the CUP WITH HANDLE (31) to cap it; additionally, the figure demonstrates how the Gamma-Ring Footing of the CUP WITH HANDLE (32) settles stably into the Medium-Flared Pedestal Footing of the inverted SAUCER (54), which shows how the CUP WITH HANDLE (8) capped with the inverted SAUCER (7) can be stacked with another CUP WITH HANDLE (8) capped with the inverted SAUCER. (7)

As a summary, the preferred embodiment comprises first tableware member having a base portion connected to generally upstanding sidewall portions to define a height of said tableware member, with an interior surface and an external surface, said sidewall portion having a recessed platform creating an interior raised ledge disposed adjacent to said generally upstanding sidewall portions at an intermediate position along said height such that portions of said sidewall portions are positioned above and below said interior raised ledge, thereby placing said interior raised ledge being positioned between said base portion and said lip, said sidewall portion opposite said base portion terminating in a peripherally extending lip.

A second tableware member having a base portion connected to generally upstanding sidewall portions to define a height of said tableware member, with an interior surface and an external surface, said sidewall portion having a recessed platform creating an interior raised ledge disposed adjacent to said generally upstanding sidewall portions at an intermediate position along said height such that portions of said sidewall portions are positioned above and below said interior raised ledge, thereby placing said interior raised ledge being positioned between said base portion and said lip, said sidewall portion opposite said base portion terminating in a peripherally extending lip, said second tableware member lid dish lip terminating in a peripherally extending rim. The first tableware member serving as a base dish for retaining substances and designed to accept a lid dish.

The second tableware member serving as a dish and, when inverted, as a lid dish designed to nest onto said first tableware member base dish to cover the contents of said first tableware member base dish so that the interior surface of the said base dish faces the interior surface of the said lid dish. The second tableware member lid dish having a flared pedestal footing, which, when upright and serving as a dish, is designed to serve as the footing of said dish, and, when inverted and being used as a lid, is designed to serve as a grip in order to remove the lid dish from said first tableware member serving as a base dish.

The interior raised ledge of said first tableware member base dish designed to receive said rim of said second tableware member lid dish such that when said lid dish is placed upon said base dish in order to form a lidded dish, said lid dish lip and rim rest upon said interior raised ledge and is held in place by said sidewall portions extending upward from said interior raised ledge. Said interior raised edge of a base dish comprises a flange serving as a receiving portion for receiving and corresponding to said rim of said lid dish due to said interior raised ledge and said rim having a substantially similar profile. In the preferred embodiment of this dishware collection, the combination tableware arrangements of the base dish and the lid dish to form lidded-containers are the following: dinner plate and pasta bowl; deep-dish server and pasta bowl, pasta bowl and side dish; pasta bowl and cereal bowl; salad plate and side dish; salad plate and cereal bowl; side dish and saucer; cereal bowl and saucer.

The first tableware member base dish having a plurality of ring footings on the bottom and outside portion of said base dish. The ring footing of said base dish designed to nest inside of the flared pedestal footing such that when a base dish rests upon an inverted lid dish, the footed ring of a base dish is circumscribed by the flared pedestal footing of the lid dish, thereby securing the base dish on top of the lid dish. In fact, the preferred embodiment comprises a plurality of types of base dishes and a plurality of types of lid dishes, and several dishes that can serve as both a base dish and a lid dish, wherein the base dishes in this preferred embodiment include dinner plate, deep-dish server, pasta bowl, salad plate, side dish, and cereal bowl and the lid dishes include pasta bowl, side dish, cereal bowl, and saucer. The footings of the base dishes which do not serve as lids (dinner plate, deep-dish server, pasta bowl, and one of the lid dishes which also can serve a base dish, the side dish) are ring footings that comprise a first ring and a second ring, said first ring larger in diameter than said second ring wherein the diameter and configuration of said rings fit within said flared pedestal footings. In the preferred embodiment, the lid dishes are designed specifically to be inverted and used as lids, and each of these has a flared pedestal footing or a protruding exterior ledge near the footing (as in the case of the SIDE DISH) that allows one to gain leverage when inverted to grab hold of lid dish to set it down on or to lift it up off a base dish. Although in the preferred embodiment, the fittings that allow different lidded-containers to stack on one another all involve either a ring footing (either the alpha-ring footing or beta-ring footing) settling into or onto a flared pedestal (either the large-flared pedestal footing or the medium-flared pedestal footing), in another embodiment it would possible to design ring footings (comparable to the alpha-ring footing and beta-ring footing but of different diameters) such that the different-sized ringed footings would dovetail with each other and allow for stable stacking.

In addition to the foregoing, and in another embodiment, a dish has at least one footed ring without any flared footing, but is configured so that the footed ring of that dish is designed to both serve as footing for when that dish is used as a base dish as well as at least one place to grasp and lift that same dish when it is serving as a lid dish in a lidded dish combination. One example of this is the preferred embodiment of the SIDE DISH. Further, one of the ring footing of a base dish is designed to nest adjacent to one of the ring footing of a lid dish such that when a base dish rests upon a lid dish, the footed ring of one of the dishes is circumscribed by the footed ring of the other dish, thereby securing the base dish on top of the lid dish.

In yet another embodiment, at least one of the dishes in the tableware arrangement collection has a side wall portion with a protruding exterior ledge portion circumscribing said external portion of said sidewall portion and disposed generally parallel to said base portion and below said interior raised ledge. A dish may have a plurality of these protruding exterior ledge portions.

In another embodiment, where at least one of said tableware members has ring footing and a protruding exterior ledge portion, when stacking lidded dish member combinations, the combination of the footing ring and exterior ledge portion is designed to contact supportingly and against one of said ring footing of the other said tableware lidded dish combination member such that when a base dish rests upon a lid dish, the footed ring of one of tableware member is bilaterally cradled by both said footed ring and said protruding exterior ledge portion of the other of tableware member, thereby securing the base dish on top of the lid dish. Still further embodiments include dishes that have a plurality of protruding exterior ledge portions.

In still further embodiments, the combination tableware arrangement comprises a plurality of types of lid dishes and a plurality of types of base dishes. In yet another embodiment, the sidewalls of the tableware members can be altered, including in height, width or other shape to form additional dish shapes.

Yet still further embodiments include the ring footing having various shapes, as the rings do not have to be circular or even rounded shape, but can be any non-round, non-circular shape, such as squares, triangles, octagons, or any shape. In another embodiment, the tableware members themselves do not have to be the traditional round dish shape as are shown in the figures, but can also be various shapes, including the entire dish or simply portions or parts of the dish, such as the rim, sidewalls, rings and each part of the alternative embodiment collection.

Although the description above contains many specificities, these should not be construed as limiting the scope of the embodiments but as merely providing illustration of several embodiments. For example, the dishware collection could vary in scale, have additional dishes included, have other shapes other than circular, such rectangular, square, triangular, et cetera. Likewise, these dishes could be fabricated in many types of material. be that ceramic, metal, stone, plastic, wood, glass, et cetera.

In conclusion, the overall scale of this dishware set, the number of dishes within it, and the materials used to make it can vary widely so long as the shared design features amongst the dishes are complimentary and repeated in ways illustrated by this preferred embodiment. When certain design features are shared to scale in common between dishes, have the same-sized interior raised ledge, ring footing, and/or a rim, these shared features will allow for different dishes to pair or stack interchangeably, forming different-sized lidded-containers and stacking arrangements, which adds versatility to the dishware system.

I claim a combination tableware arrangement comprising:

1. A combination tableware arrangement, comprising:

a first tableware member having a first base portion connected to generally upstanding first sidewall portions of said first tableware member, said first sidewall portions terminating opposite said first base portion at a first lip portion, said first lip portion thereby defining a first height of said first tableware member, said first tableware member having a first interior surface and a first external surface, said first sidewall portions having a first recessed platform creating a first interior raised ledge disposed at a first intermediate position along said first interior surface such that said first interior raised ledge is positioned between said first base portion and said first lip portion, said first lip portion having an uppermost edge terminating at an outwardly extending first rim, said first tableware member including a first ring footing on said first external surface of said first base portion, wherein said first sidewall portions define a first sidewall profile between said first base portion and said first interior raised ledge;

a second tableware member having a second base portion connected to generally upstanding second sidewall portions of said second tableware member, said second sidewall portions terminating opposite said second base portion at a second lip portion, said second lip portion thereby defining a second height of said second tableware member, said second tableware member having a second interior surface and a second external surface, said second sidewall portions having a second recessed platform creating a second interior raised ledge disposed at a second intermediate position along said second interior surface such that said second interior raised ledge is positioned between said second base portion and said second lip portion, said second lip portion having an uppermost edge terminating at an outwardly extending second rim, said second tableware member including a second ring footing on said second external surface of said second base portion, wherein said second sidewall portions define a second sidewall profile between said second base portion and said second interior raised ledge, said second sidewall profile being different than said first sidewall profile;

a third tableware member having a third base portion connected to generally upstanding third sidewall portions of said third tableware member, said third sidewall portions terminating opposite said third base portion at a third lip portion, said third lip portion thereby defining a third height of said third tableware member, said third tableware member having a third interior surface and a third external surface, said third sidewall portions having a third recessed platform creating a third interior raised ledge disposed at a third intermediate position along said third interior surface such that said third interior raised ledge is positioned between said third base portion and said third lip portion, said third lip portion having an uppermost edge terminating at an outwardly extending third rim, said third tableware member including a third ring footing on said third external surface of said third base portion, wherein said third sidewall portions define a third sidewall profile between said third base portion and said third interior raised ledge, said third sidewall profile being different than both said first sidewall profile and said second sidewall profile;

a fourth tableware member having a fourth base portion connected to generally upstanding fourth sidewall portions of said fourth tableware member, said fourth sidewall portions terminating opposite said fourth base portion at a fourth lip portion, said fourth lip portion thereby defining a fourth height of said fourth tableware member, said fourth tableware member having a fourth interior surface and a fourth external surface, said fourth sidewall portions having a fourth recessed platform creating a fourth interior raised ledge disposed at a fourth intermediate position along said fourth interior surface such that said fourth interior raised ledge is positioned between said fourth base portion and said fourth lip portion, said fourth lip portion having an uppermost edge terminating at an outwardly extending fourth rim, said fourth tableware member including a fourth ring footing on said fourth external surface of said fourth base portion, wherein said fourth sidewall portions define a fourth sidewall profile between said fourth base portion and said fourth interior raised ledge, said fourth sidewall profile being different than each of said first sidewall profile, said second sidewall profile and said third sidewall profile; wherein said first, second, third and fourth tableware members are configured such that said second tableware member is stackable with each of the first, third and fourth tableware members in the following configurations:

(1) said second tableware member in an inverted orientation and on said first tableware member in an upright orientation, with said outwardly extending second rim seated on said first interior raised ledge and said second tableware member maintained laterally in place relative to said first tableware member by said first lip portion;

(2) said first tableware member in an upright orientation and on said second tableware member in an inverted orientation, with said first ring footing in contact with an inward-facing portion of said second ring footing;

(3) said second tableware member in the inverted orientation and on said fourth tableware member in an upright orientation, with said outwardly extending second rim seated on said fourth interior raised ledge and said second tableware member maintained laterally in place relative to said fourth tableware member by said fourth lip portion;

(4) said fourth tableware member in an upright orientation and on said second tableware member in the inverted orientation, with said fourth ring footing in contact with the inward-facing portion of said second ring footing;

(5) said second tableware member in an upright orientation and on said first tableware member in an inverted orientation, with said second ring footing in contact with an outward-facing portion of said first ring footing;

(6) said first tableware member in an inverted orientation and on said third tableware member in an upright orientation, with said outwardly extending first rim seated on said third interior raised ledge and said first tableware member maintained laterally in place relative to said third tableware member by said third lip portion; and (7) said third tableware member in an upright orientation and on said second tableware member in an inverted orientation, with said third ring footing in contact with the inward-facing portion of said second ring footing.

2. The combination tableware arrangement of claim 1, wherein said second ring footing is a flared, pedestal footing.

3. The combination tableware arrangement of claim 1, wherein said first ring footing is a first inner ring footing and said first tableware member further includes a first outer ring footing on said first external surface of said first base portion and disposed outwardly of said first inner ring footing, wherein said third ring footing is a third inner ring footing and said third tableware member further includes a third outer ring footing on said third external surface of said third base portion and disposed outwardly of said third inner ring footing, wherein said first tableware member and said third tableware member are configured such that said first tableware member is stackable with said third tableware member in the following configuration:

(8) said third tableware member in the upright orientation and on said first tableware member in the inverted orientation, with said third outer ring footing in contact with an inward-facing portion of said first outer ring footing.

4. The combination tableware arrangement of claim 3 wherein said first inner ring footing has a distal edge that is offset, in a direction toward said first base portion, from a distal edge of said first outer ring footing.

5. A combination tableware arrangement, comprising:

a first tableware member having a first base portion connected to generally upstanding first sidewall portions that terminate opposite said first base portion at a first lip portion to define a first height of said first tableware member, with a first interior surface and a first external surface, said first sidewall portions having a first recessed platform creating a first interior raised ledge disposed adjacent to said generally upstanding first sidewall portions at a first intermediate position along said first interior surface such that said first interior raised ledge is positioned between said first base portion and said first lip portion, said first lip portion terminating in a peripherally extending first rim, said first tableware member including a first ring footing on said first external surface of said first base portion, wherein said first sidewall portions define a first sidewall profile between said first base portion and said first interior raised ledge;

a second tableware member having a second base portion connected to generally upstanding second sidewall portions that terminate opposite said second base portion at a second lip portion to define a second height of said second tableware member, with a second interior surface and a second external surface, said second sidewall portions having a second recessed platform creating a second interior raised ledge disposed adjacent to said generally upstanding second sidewall portions at a second intermediate position along said second interior surface such that said second interior raised ledge is positioned between said second base portion and said second lip portion, said second lip portion terminating in a peripherally extending second rim, said second tableware member including a second ring footing on said second external surface of said second base portion, wherein said second sidewall portions define a second sidewall profile between said second base portion and said second interior raised ledge, said second sidewall profile being different than said first sidewall profile;

a third tableware member having a third base portion connected to generally upstanding third sidewall portions that terminate opposite said third base portion at a third lip portion to define a third height of said third tableware member, with a third interior surface and a third external surface, said third sidewall portions having a third recessed platform creating a third interior raised ledge disposed adjacent to said generally upstanding third sidewall portions at a third intermediate position along said third interior surface such that said third interior raised ledge is positioned between said third base portion and said third lip portion, said third lip portion terminating in a peripherally extending third rim, said third tableware member including a third ring footing on said third external surface of said third base portion, wherein said third sidewall portions define a third sidewall profile between said third base portion and said third interior raised ledge, said third sidewall profile being different than both said first sidewall profile and said second sidewall profile;

wherein said first, second and third tableware members are configured such that said second tableware member is stackable with each of the first and third tableware members in the following configurations:

(1) said second tableware member in an inverted orientation and on said first tableware member in an upright orientation, with said outwardly extending second rim seated on said first interior raised ledge and said second tableware member maintained laterally in place relative to said first tableware member by said first lip portion;

(2) said first tableware member in an upright orientation and on said second tableware member in an inverted orientation, with said first ring footing in contact with an inward-facing portion of said second ring footing;

(3) said first tableware member in an inverted orientation and on said third tableware member in an upright orientation, with said outwardly extending first rim seated on said third interior raised ledge and said first tableware member maintained laterally in place relative to said third tableware member by said third lip portion;

wherein said first ring footing is a first inner ring footing and said first tableware member further includes a first outer ring footing on said first external surface of said first base portion and disposed outwardly of said first inner ring footing, wherein said third ring footing is a third inner ring footing and said third tableware member further includes a third outer ring footing on said third external surface of said third base portion and disposed outwardly of said third inner ring footing, wherein said first tableware member and said third tableware member are configured such that said first tableware member is stackable with said third tableware member in the following configuration:

(4) said third tableware member in the upright orientation and on said first tableware member in the inverted orientation, with said third outer ring footing in contact with the inward-facing portion of said first outer ring footing.

6. The combination tableware arrangement of claim 5, wherein said first inner ring footing has a distal edge that is offset, in a direction toward said first base portion, from a distal edge of said first outer ring footing.

7. The combination tableware arrangement of claim 6 wherein said second ring footing is outwardly flared to serve as a grip when said second tableware member is in the inverted orientation.

8. The combination tableware arrangement of claim 1, wherein each of said first tableware member, said second tableware member, said third tableware member and said fourth tableware member are formed of a ceramic, stone or glass material.

9. The combination tableware arrangement of claim 8, wherein:

a perimeter dimension of said first lip portion is the same as a perimeter dimension of said fourth lip portion;

a perimeter dimension of said second lip portion is less than said perimeter dimension of said first lip portion; and a perimeter dimension of said third lip portion is greater than said perimeter dimension of said first lip portion.

10. The combination tableware arrangement of claim 9, wherein:

said first height is greater than said fourth height;

said second height is greater than said first height; and said third height is less than said first height.

11. The combination tableware arrangement of claim 3, wherein said fourth ring footing is a fourth inner ring footing and said fourth tableware member further includes a fourth outer ring footing on said fourth external surface of said fourth base portion and disposed outwardly of said fourth inner ring footing, wherein said first tableware member and said fourth tableware member are configured such that said first tableware member is stackable with said fourth tableware member in the following configuration:

(9) said fourth tableware member in an upright orientation on said first tableware member in an upright orientation, with said fourth outer ring footing in contact with the inward-facing portion of said first outer ring footing.

12. The combination tableware arrangement of claim 5, wherein said first ring footing is a first inner ring footing and said first tableware member further includes a first outer ring footing on said first external surface of said first base portion and disposed outwardly of said first inner ring footing, wherein said third ring footing is a third inner ring footing and said third tableware member further includes a third outer ring footing on said third external surface of said third base portion and disposed outwardly of said third inner ring footing, wherein said first tableware member and said third tableware member are configured such that said first tableware member is stackable with said third tableware member in the following configuration:

(5) said third tableware member in the upright orientation and on said first tableware member in the inverted orientation, with said third outer ring footing in contact with an inward-facing portion of said first outer ring footing.

13. The combination tableware arrangement of claim 12, wherein said fourth ring footing is a fourth inner ring footing and said fourth tableware member further includes a fourth outer ring footing on said fourth external surface of said fourth base portion and disposed outwardly of said fourth inner ring footing, wherein said first tableware member and said fourth tableware member are configured such that said first tableware member is stackable with said fourth tableware member in the following configuration:

(6) said fourth tableware member in an upright orientation on said first tableware member in an upright orientation, with said fourth outer ring footing in contact with the inward-facing portion of said first outer ring footing.

14. The combination tableware arrangement of claim 5, wherein each of said first tableware member, said second tableware member and said third tableware member are formed of a ceramic, stone or glass material.

15. The combination tableware arrangement of claim 14, wherein:

a perimeter dimension of said second lip portion is less than a perimeter dimension of said first lip portion; and a perimeter dimension of said third lip portion is greater than said perimeter dimension of said first lip portion.

16. The combination tableware arrangement of claim 15, wherein:

said second height is greater than said first height; and said third height is less than said first height.

* * * * *